US006926747B2

(12) United States Patent
Udwin

(10) Patent No.: US 6,926,747 B2
(45) Date of Patent: Aug. 9, 2005

(54) DEMOUNTABLE MULTI-PURPOSE EXERCISE DEVICE

(76) Inventor: Eliezer Udwin, 56/4 Nativ Hamazalot St., Pisget Zeev 97830, Jerusalem (IL)

( * ) Notice: Subject to any disclaimer, the term of this patent is extended or adjusted under 35 U.S.C. 154(b) by 0 days.

(21) Appl. No.: 10/453,997

(22) Filed: Jun. 4, 2003

(65) Prior Publication Data

US 2004/0152571 A1 Aug. 5, 2004

Related U.S. Application Data

(63) Continuation-in-part of application No. 10/354,103, filed on Jan. 30, 2003, now abandoned.

(51) Int. Cl.[7] ..... A63B 21/00
(52) U.S. Cl. ..... 48/126; 482/121; 482/127
(58) Field of Search ..... 482/121–126, 482/127, 44, 45

(56) References Cited

U.S. PATENT DOCUMENTS 3,268,225 A 8/1966 Kölbel
3,746,339 A * 6/1973 Cox
4,290,599 A * 9/1981 Berger
5,031,906 A * 7/1991 Jang

* cited by examiner

*Primary Examiner*—Jerome W. Donnelly
(74) *Attorney, Agent, or Firm*—Emrich & Dithmar LLC; Paul L. Brown

(57) ABSTRACT

A demountable multi-purpose exercise device including a pair of elongate plunger members, a central guide member having a pair of oppositely disposed portions for demountable telescopic engagement with the pair of elongate plunger members. Further included is a depressible resilient means disposed between the pair of elongate plunger members and the central guide member, operative to permit mutual contraction of the plunger members in response to opposing axial forces applied thereto. There is an elongate flexible member longitudinally looped about the exercise device in engagement with the pair of elongate plunger members. Further, there are included, for use with the exercise device an exercise apparatus comprising retractable spool or drum members in cylindrical casings and elongate flexible members fixably attached and resiliently coiled about the spool members to be uncoiled in response to a force applied thereto.

16 Claims, 23 Drawing Sheets

DEMOUNTABLE MULTI-PURPOSE EXERCISE DEVICE

The present application is a continuation-in-part application of U.S. Ser. No. 10/354,103, filed on Jan. 30, 2003 now abandoned and entitled Demountable Multi-Purpose Exercise Device in the name of the present inventor.

FIELD OF THE INVENTION

The present invention relates, generally to an exercise device and, more specifically, to an exercise device, which can be easily disassembled.

BACKGROUND OF THE INVENTION

It is known in the art to provide exercise devices to facilitate exercises to promote or maintain physical fitness, generally for human use. These devices fall into two broad categories, namely, portable and non-portable. The latter include items, which are portable simply by virtue of their physical size or weight. However, these are generally limited in the scope of exercises which can be performed by their use.

Referring now to U.S. Pat. No. 3,268,225 to Kölbel, on Aug. 23, 1966, entitled "Spring Type Physical Exerciser," there is disclosed an exercising device having an internal telescopic tube, slidable within an external tube and having a spring disposed within the tubes. The external extremity of each tube has a handle affixed thereto, which acts as a closure to support the spring therewithin. By pressing on both handles, exercises requiring a pushing or compressing effort may be performed. An endless rope-like loop passes through recesses formed in each handle and is fixed thereto, such that the tubes are maintained somewhat under tension with respect to each other and to the spring. The rope may be provided with two handles formed or fixed thereto, disposed on either side of the telescopic tubes to facilitate exercises that require a pulling or expanding movement or effort. The rope also prevents the tubes and handles from springing apart.

The abovementioned device, while providing features for performing multiple exercises, is portable only to a limited extent. Being, of necessity, a lengthy device having a fixed assembly of its component parts, it is not intended for quick and convenient disassembly to facilitate compact packing and transporting, and for quick subsequent re-assembly for use.

SUMMARY OF THE INVENTION

The present invention aims to provide a lightweight, demountable, multi-purpose, exercise device, which is easily assembled for use and disassembled for convenience of packing or for conveying while the user is travelling. The multi-purpose exercise device is usable, generally but not exclusively, by humans for performing a wide variety of exercises, including the actions of compressing, pulling, pushing, expanding or drawing apart.

According to a preferred embodiment of the present invention, there is provided a demountable multi-purpose exercise device including a pair of elongate plunger members, each having a first end portion and a second end portion. The exercise device also includes a central guide member having a pair of oppositely disposed portions for demountable telescopic engagement with the second end portions of the pair of elongate plunger members. Further included is a depressible resilient means disposed between the pair of elongate plunger members and the central guide member, operative to permit mutual contraction of the plunger members in response to opposing axial forces of at least a predetermined magnitude applied thereto via the first ends thereof.

According to a first embodiment of the present invention, the demountable multi-purpose exercise device also includes an elongate flexible member operative to be longitudinally looped about the remainder of the exercise device in engagement with the first end portions of the pair of elongate plunger members. The elongate flexible member is configured to be of a length so as to retain the pair of plunger members in engagement with the central guide member.

According to a variation of the embodiment of the present invention, the demountable multi-purpose exercise device also includes means for selectably fastening the elongate flexible member to the first end portions of the pair of elongate plunger members.

According to another variation of the embodiment of the present invention, the flexible member is formed as a continuous, endless loop.

According to a further variation of the embodiment of the present invention, the elongate flexible member is formed as a pair of elongate flexible elements.

According to an added variation of the embodiment of the present invention, the elongate flexible member is arranged to be demountably engaged to the first end portions of the plunger members such that, applying a transverse force to the flexible member, the elongate flexible member is operative to apply opposing axial forces to the first end portions of the elongate plunger members to permit mutual contraction of the plunger members.

According to a second embodiment of the present invention, the elongate flexible member includes at least one handhold disposed along a portion of the elongate flexible member, and affixed thereto, thereby to provide a means for gripping the elongate flexible member.

According to a third embodiment of the present invention, the elongate flexible member includes attached thereto an extended elongate flexible element so as to attach the extended elongate flexible element to a user's limbs.

According to a fourth embodiment of the present invention, the first end portions of the elongate plunger members have handle elements disposed at the first end portions thereof, so as to facilitate a user applying opposing axial forces to the first end portions of the elongate plunger members.

According to a fifth embodiment of the present invention, the depressible resilient means includes one or more resilient means selected from one or more helical springs; one or more pairs of concave resilient washers disposed in an opposing arrangement; resilient foam polymer material; and a gas filled resilient container.

According to a sixth embodiment of the present invention, the depressible resilient means is disposed in at least one arrangement selected from within one or both of the plungers or the guide member, or external to one or both of the plungers or the guide member.

According to another preferred embodiment of the present invention, there is provided a demountable multi-purpose exercise device including an elongate plunger member, having a first end portion and a second end portion. There is also included a guide member having a first end portion and a second end portion oppositely disposed such that the second portion is formed for demountable telescopic engagement with the second end portion of the elongate plunger member. Further there is a depressible resilient means provided between the elongate plunger member and the guide member, operative to permit mutual contraction of the elongate plunger member and the guide member in response to opposing axial forces applied thereto via the first end portion of the plunger member and the first portion of the guide member.

According to a seventh embodiment of the present invention, the demountable multi-purpose exercise device also includes an elongate flexible member operative to be longitudinally looped about the remainder of the exercise device in engagement with the first end portions of the elongate plunger member and the guide member, and configured to be of a length so as to retain the pair of plunger members in engagement with the central guide member.

According to a variation of the embodiment of the present invention, the demountable multi-purpose exercise device also includes means for selectably fastening the elongate flexible member to the first end portions of the elongate plunger member and the central guide member.

According to another variation of the embodiment of the present invention, the flexible member is formed as a continuous, endless loop.

According to an added variation of the embodiment of the present invention, the flexible member is formed as a pair of flexible elements.

According to a further variation of the embodiment of the present invention, the elongate flexible member is arranged to be demountably engaged to the first end portion of the elongate plunger member and the first portion of the guide member such that, applying a transverse force to the elongate flexible member, the elongate flexible member is operative to apply opposing axial forces to the first portion of the elongate plunger member and to the first portion of the guide member to permit mutual contraction of the elongate plunger member and the guide member.

According to an eighth embodiment of the present invention, the elongate flexible member includes at least one handhold disposed along a portion of the elongate flexible member, and affixed thereto, thereby to provide a means for gripping the elongate flexible member.

According to a variation of the embodiment of the present invention, the elongate flexible member includes attached thereto an extended elongate flexible element so as to attach the extended elongate flexible element to a user's limbs.

According to a ninth embodiment of the present invention, the first end portion of the elongate plunger member and the first portion of the guide member have handle elements disposed at the first end portions of the elongate plunger member and the first portion of the guide member, so as to facilitate a user applying opposing axial forces to the first end of the elongate plunger member and to the first portion of the guide member.

According to a tenth embodiment of the present invention, the depressible resilient means includes one or more resilient means selected from one or more helical springs; one or more pairs of concave resilient washers disposed in an opposing arrangement; resilient foam polymer material or gas filled resilient containers.

According to an eleventh embodiment of the present invention, the depressible resilient means is disposed in one or more arrangement selected from within the elongate plunger or guide member or external to the elongate plunger or the guide member.

According to a further preferred embodiment of the present invention, there is provided an exercise apparatus for use with a demountable multi-purpose exercise device. The demountable multi-purpose exercise device includes a pair of elongate plunger members and a guide member arranged for mutual, relative, resilient contraction along a common axis. The exercise apparatus includes one or more retractable spool members rotationally mounted within a substantially cylindrical casing having a cylindrical axial mounting opening formed therethrough. The exercise apparatus further includes one or more elongate flexible members fixably attached by a first end thereof to one or more spool members. The elongate flexible members are arranged to be resiliently coiled about spool members and adapted to be uncoiled in response to a force greater than a resistance force applied thereto via the spool member. One or more retractable spools are operative to recoil one or more elongate flexible members thereabout in the absence of a force greater than the resistance force.

According to a twelfth embodiment of the present invention, one or more of the exercise apparatus is demountably disposed on a guide member.

According to a thirteenth embodiment of the present invention, the exercise apparatus includes a brake element disposed thereon so as to apply a preselected resistance force to the retractable spool member.

BRIEF DESCRIPTION OF THE DRAWINGS

The present invention will be more fully understood and its features and advantages will become apparent to those skilled in the art by reference to the ensuing description, taken in conjunction with the accompanying drawings, in which.

DETAILED DESCRIPTION OF THE INVENTION

At present, many people expend a substantial amount of time travelling, be it for business or pleasure. While not travelling, those who wish to do physical exercises have the opportunity to visit their local gymnasium or sports facility. While travelling, however, this is not such a simple matter. There is therefore a need for facilitating an exercise program for travelers, utilizing a lightweight, portable and simple exercise device. The present invention seeks to provide such a device, which is easily assembled, from a few component parts, easily disassembled and is very compact and portable. Furthermore it is usable for a wide range of exercises for the arms, legs, chest, back, stomach and posterior.

Figure 1:
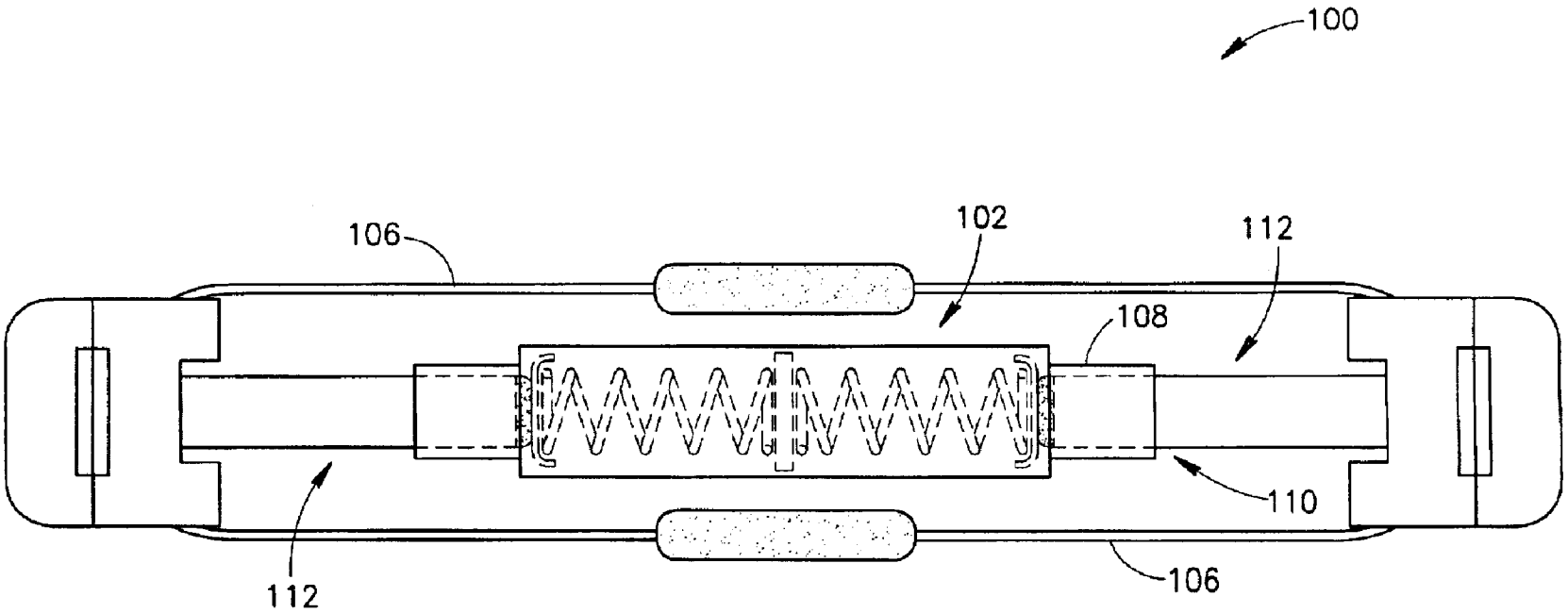
FIG. 1 is a partial cross-sectional view of a demountable exercise device, according to a preferred embodiment of the present invention.
Figure 2:
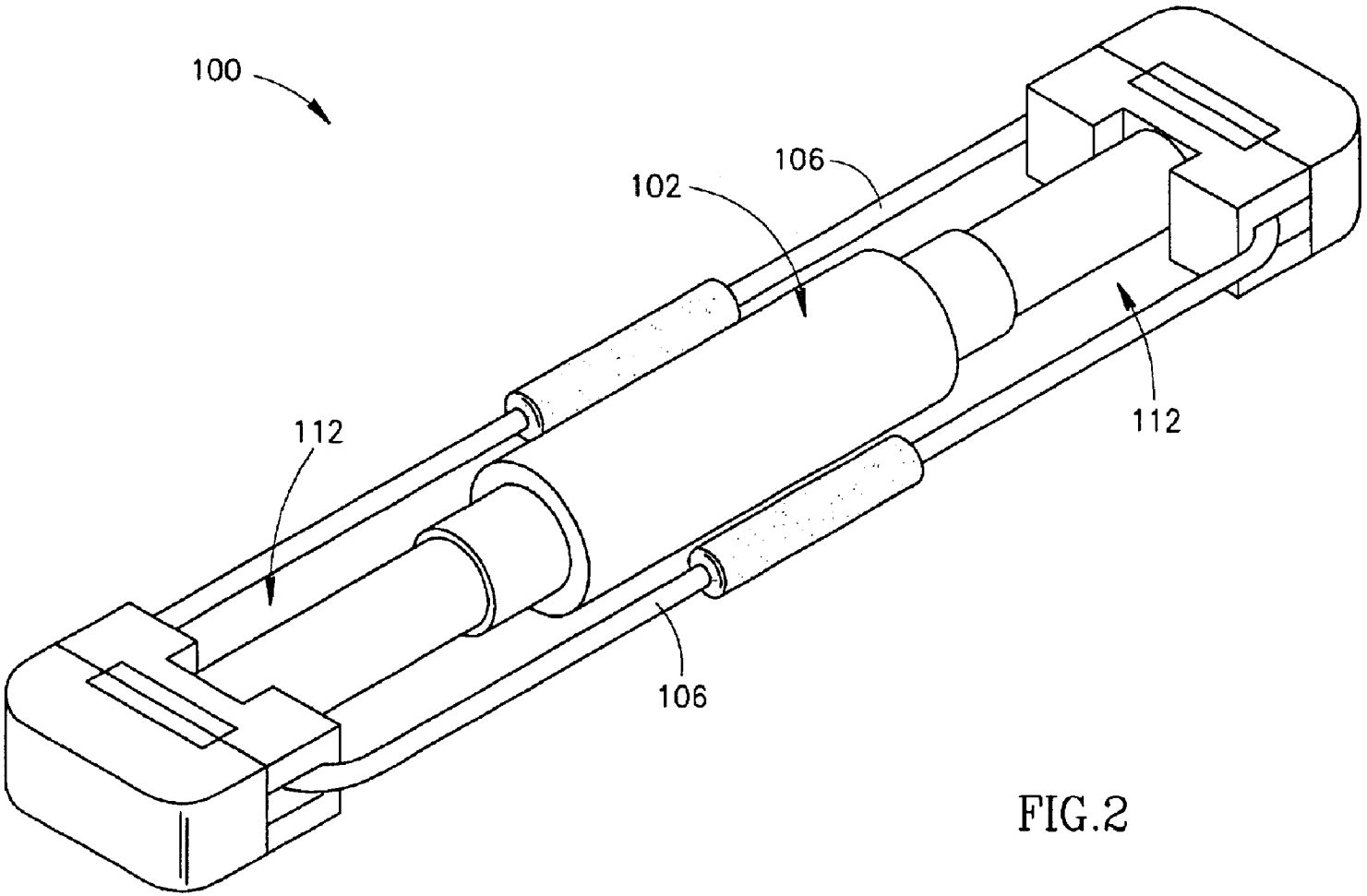
FIG. 2 is a perspective view of the demountable exercise device of FIG. 1.

With reference to FIGS. 1 and 2, there is seen a demountable exercise device 100, in accordance with a preferred embodiment of the present invention. Device 100 is seen assembled from its component parts, comprising a central guide member 102, a pair of plunger members 112 and a flexible member or cord 106.

Figure 3:
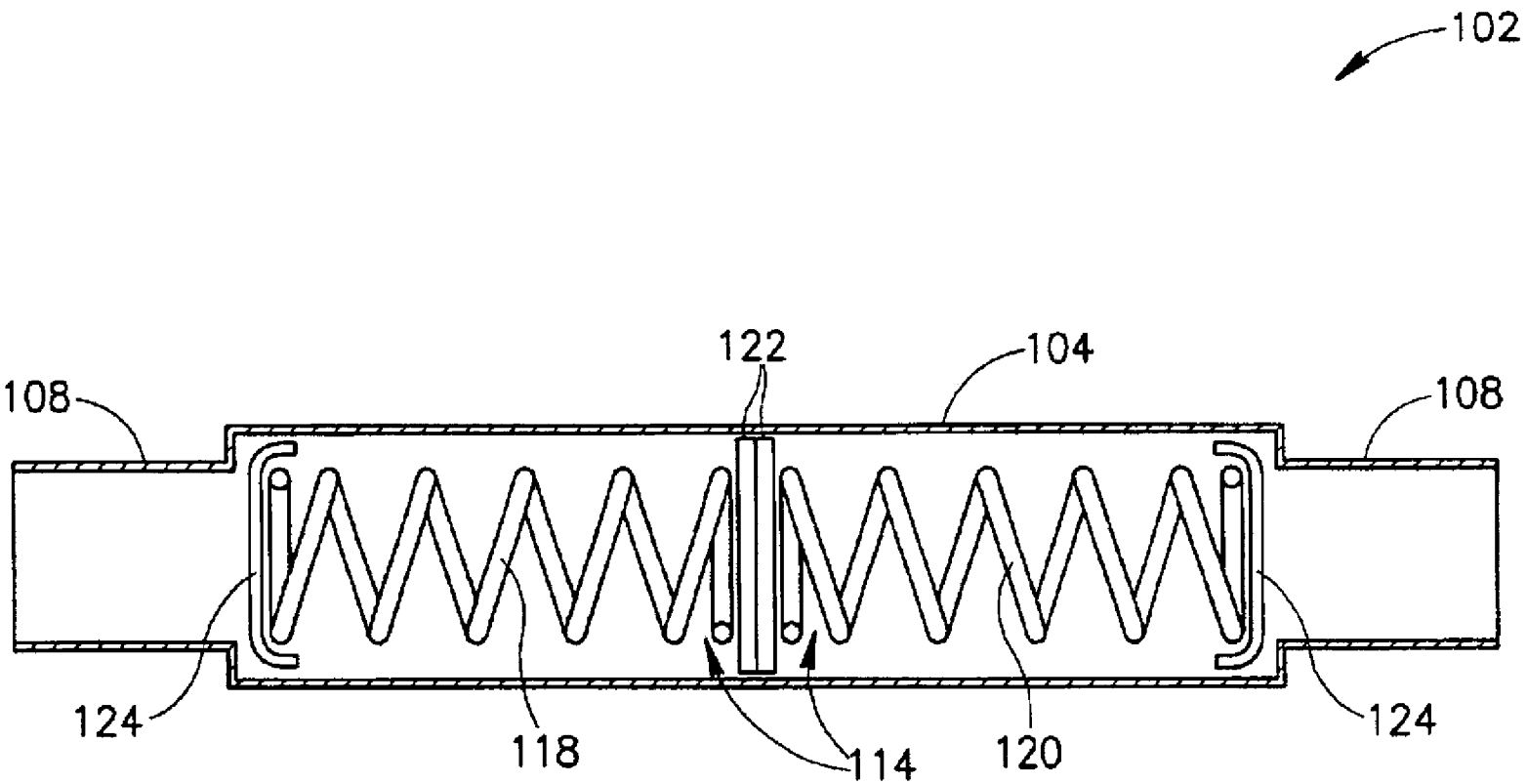
FIG. 3 illustrates a cross-sectional view of a central guide member of the demountable exercise device of FIG. 1.

Referring now, additionally, to FIG. 3, there is seen, according to an embodiment of the present invention, central guide member 102, having an outer tubular casing 104. Central guide member 102 has oppositely disposed guide tubes 108 for demountable telescopic engagement with second end portions 110 (as disclosed hereinbelow with reference to FIG. 4) of plunger members 112 (FIG. 1). Alternative constructions to guide tubes 108 are disclosed with reference to FIGS. 10 and 11.

Figure 4:
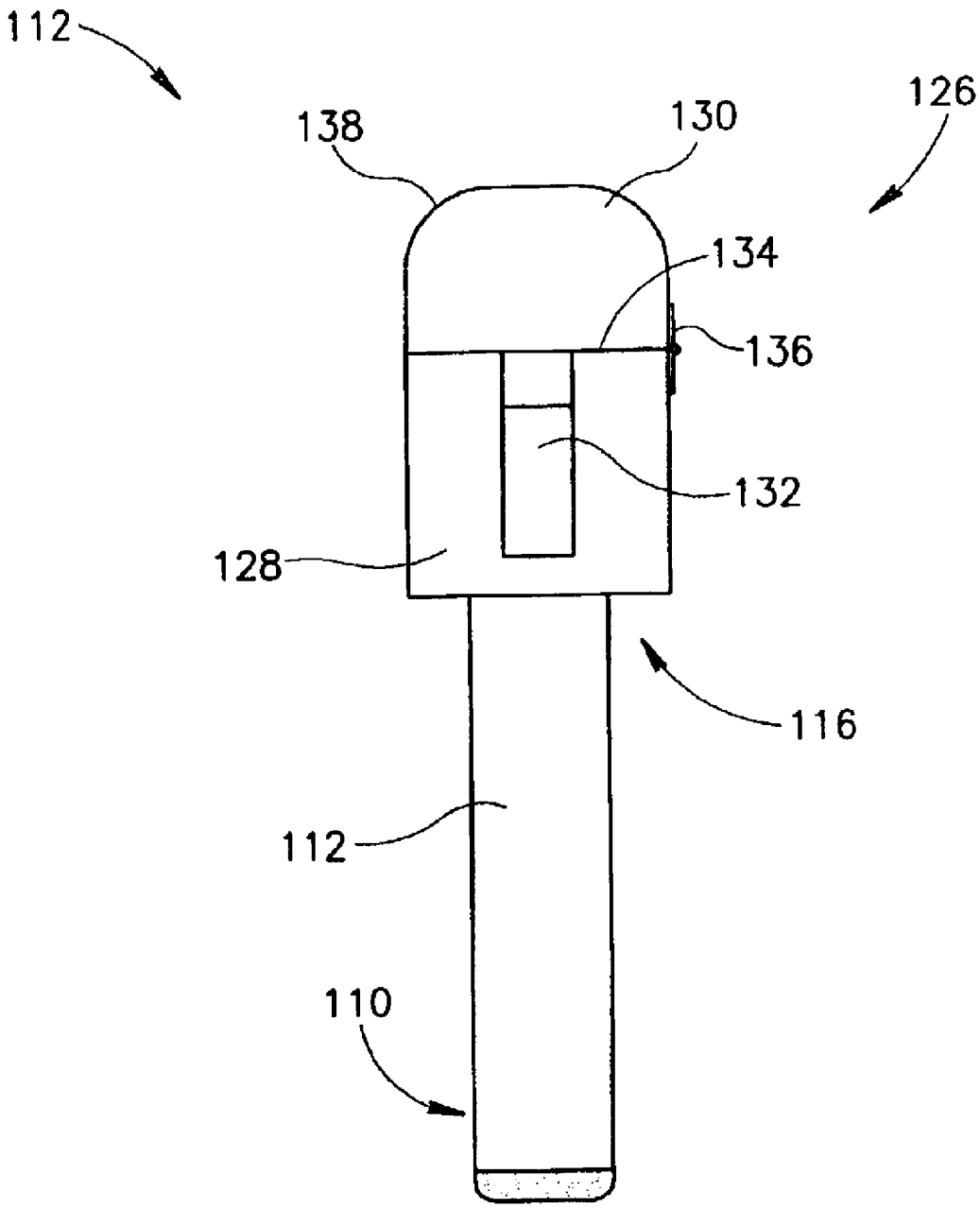
FIG. 4 illustrates a plunger member of the demountable exercise device of FIG. 1.

Disposed within casing 104 is a depressible resilient means 114, operative to permit mutual contraction of plunger members 112 (FIG. 1) in response to opposing axial forces applied thereto via first ends or handles 116 thereof, as disclosed with reference to FIG. 4. Alternatives to resilient means 114 are further disclosed hereinbelow with reference to FIGS. 11 and 12.

Resilient means 114 is seen, according to another embodiment of the present invention, as two springs 118 and 120, separated by spring separation discs 122, centrally disposed within casing 104. Discs 122 may be fixably attached within casing 104, may be spring discs or may be attached one to the other. To reduce noise and friction between the interior of casing 104 and springs 118 and 120, either the interior of casing 104 or the outer surface of springs 118 and 120, or both, may be coated with a low friction polymer such as, for example, PTFE (polytetrafluoroethylene) or polypropylene, or surface treated with a suitable dry lubricant such as, for example, molybdenum disulfide.

Alternative to two springs 118 and 120, according to alternative embodiments of the present invention, there may be disposed within casing 104, a single helix spring (not shown), a resilient compressible polymer or foam rubber rod, a series of pairs of concave resilient washers disposed in an opposing arrangement, or a gas-filled resilient container or various combinations of these.

At each end within casing 104 there are cup-shaped washers 124 disposed against each end of resilient means 114, thereby to retain resilient means 114 within casing 104 and to facilitate compression of resilient means 114 by second ends 110 of plungers 112, as disclosed with reference to FIG. 4.

Figure 5:
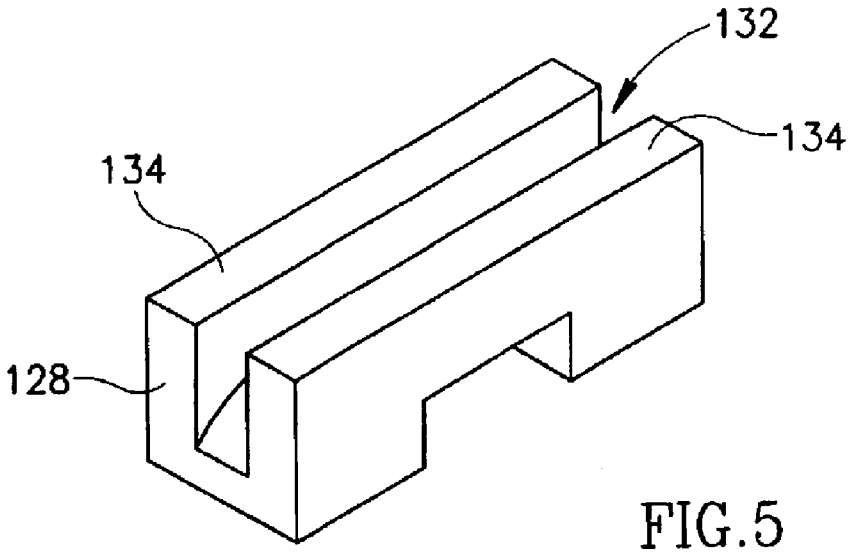
FIG. 5 is a perspective view of a base portion of a handle element of the plunger of FIG. 4.
Figure 6:
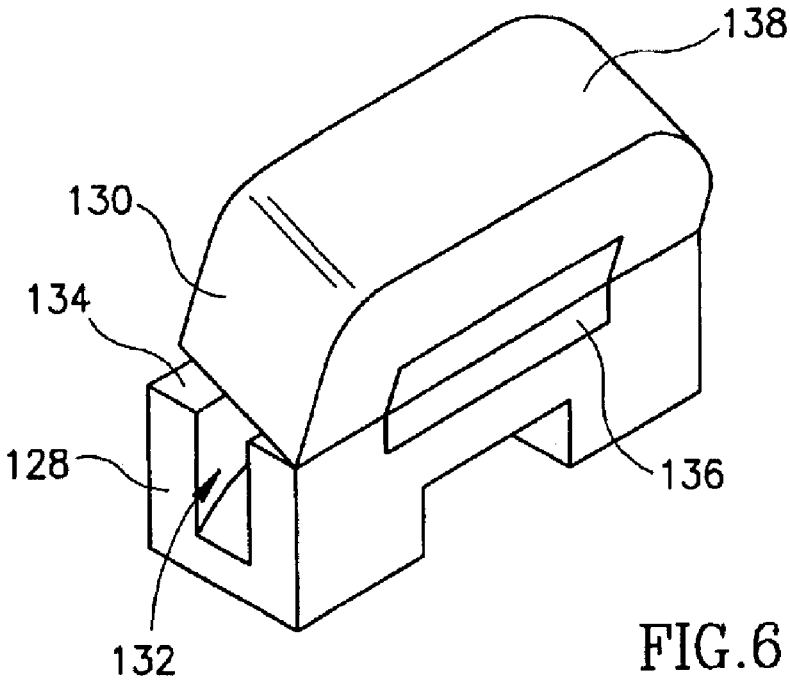
FIG. 6 is a perspective view of a base portion and a handhold portion of the handle element of the plunger member of FIG. 4.

Referring now to FIGS. 4–6, there is seen plunger member 112 having a first end 116 and a second end 110. According to a further embodiment of the present invention, there is a handle element 126, comprising a base portion 128 and a handhold portion 130, disposed at first end 116 of plunger 112. Base portion 128 is fixably attached to first end 116 of plunger 112, and has a groove 132 formed in outer surface 134 thereof to accommodate a flexible member or cord 106 (FIG. 1). Hingably attached to outer surface 134 of base portion 128 by a hinge mechanism 136 is handhold portion 130, having a curved outer surface 138 to accommodate a hand of a user. To further accommodate the user's hand, ribs may be formed in curved outer surface 138. To secure handhold portion 130 in a closed position, hinge mechanism 136 is formed having a self-closing spring closure (not shown) or a securing latch (not shown). Alternative means for accommodating alternative forms of flexible member 106 are disclosed with reference to items 152 and 172 in FIGS. 8 and 9, respectively.

Figure 7:
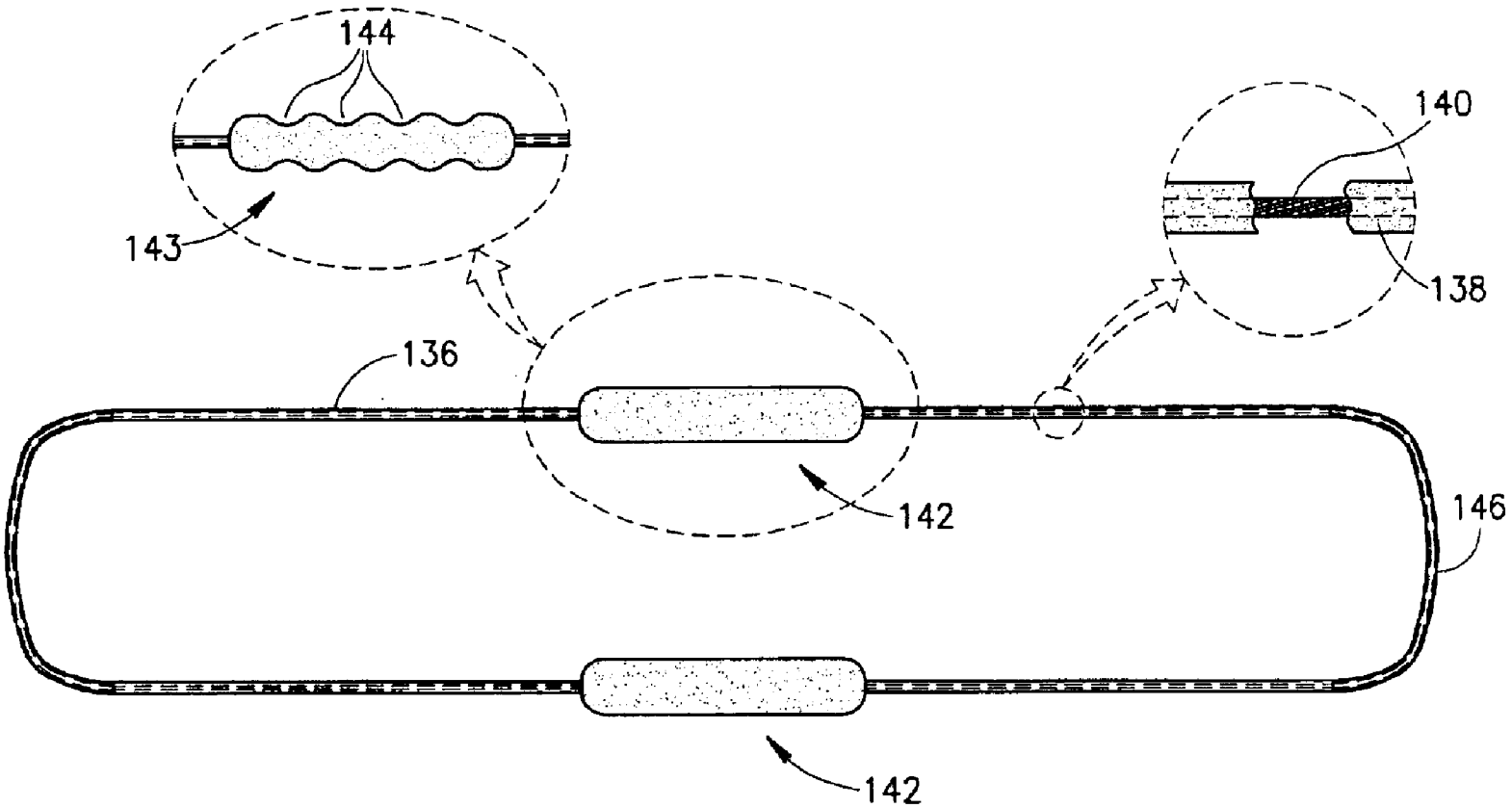
FIG. 7 illustrates a flexible member or cord, in accordance with an embodiment of the present invention.

Referring now to FIG. 7, in accordance with an added embodiment of the present invention, there is seen flexible member or cord 136, which is formed as an endless loop. Cord 136 is formed having a plastic polymer covering 138 either molded or braided about a central reinforcing core 140 formed from steel wire, fiberglass filament or other suitable material. Cord 136 has handholds 142 disposed on opposite sides thereof, which may be of a firm material such as hard rubber or plastic. Handholds 142 may be formed as simple cylindrical shapes or formed in accordance with molded handholds 143, having molded ridges 144 as seen in "A", to better accommodate the fingers of a user. In order to facilitate correctly positioning cord 136, end portions 146 may be color-coded so as to accommodate these into each groove 132 of base portion 128 of each plunger 112 (FIG. 4).

The procedure for assembling exercise device 100, referring to FIGS. 1–7, is as follows: Plungers 112 are inserted into guide tubes 108 of central guide member 102. Thereafter, cord 136 is accommodated into grooves 132 of base portion 128 of each handle 126 and handhold portions 130 are closed against base portions 128. The procedure for disassembly is generally the reverse of that for assembly.

Figure 8:
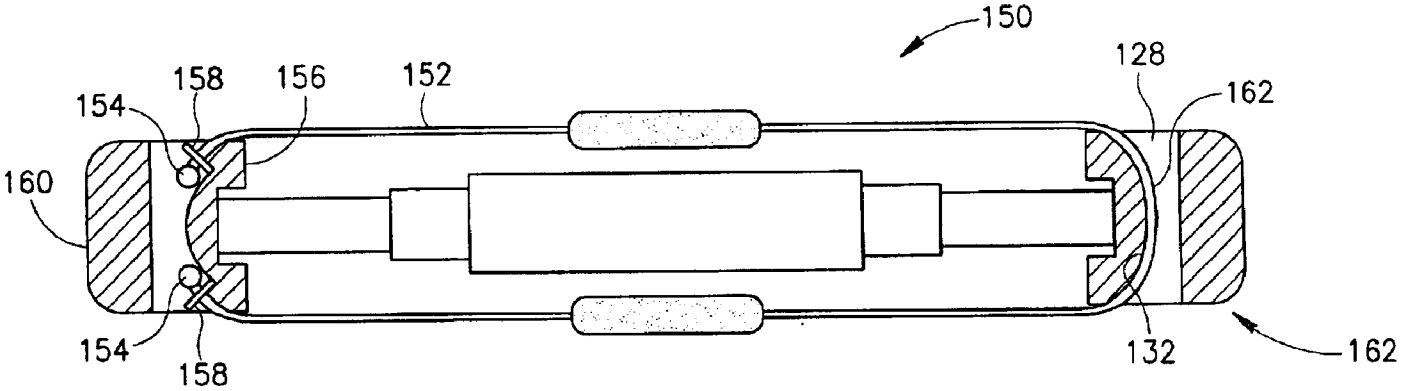
FIG. 8 illustrates a partial cross-sectional view, in accordance with a further embodiment of the present invention, of an alternative flexible member formed as a single length cord attached to a demountable exercise device.

Referring now to FIG. 8, in accordance with a further embodiment of the present invention, an alternative flexible member 150 is formed as a single length cord 152 having attachment fasteners 154 formed at each extremity 156, fastened to attachment lugs 158 formed on one plunger handle 160. A mid-section 162 of cord 152 is looped over groove 132 formed in handle base 128, as disclosed with reference to FIGS. 4–6 of hand element 126.

Figure 9:
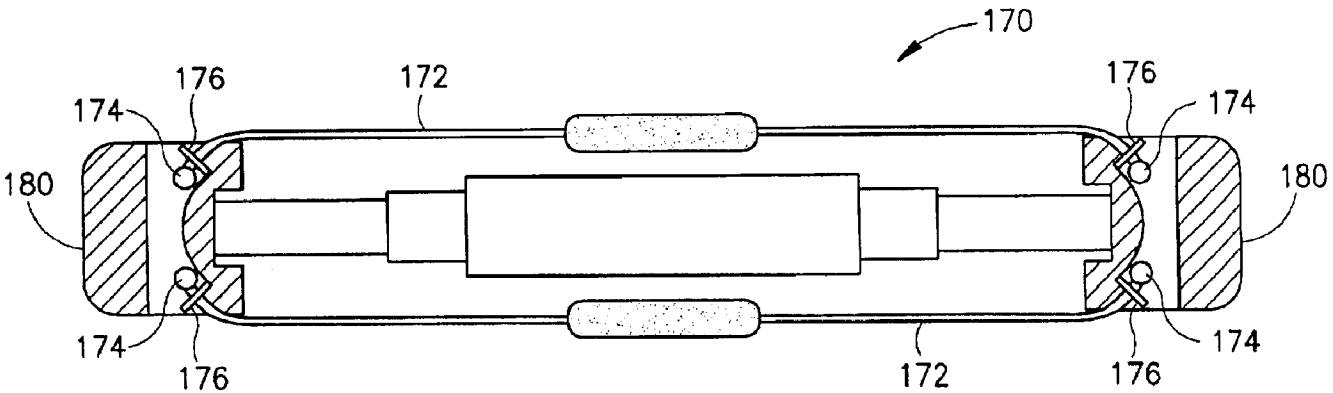
FIG. 9 illustrates a partial cross-sectional view, in accordance with another embodiment of the present invention, of an alternative flexible member formed of cords attached to a demountable exercise device.

Referring now to FIG. 9, in accordance with an additional embodiment of the present invention, resilient member 170 is formed as a pair of cords 172, each having attachment fasteners 174 formed at each end thereof, which are fastened to attachment lugs 176 formed on each plunger handle 180.

Figure 10:
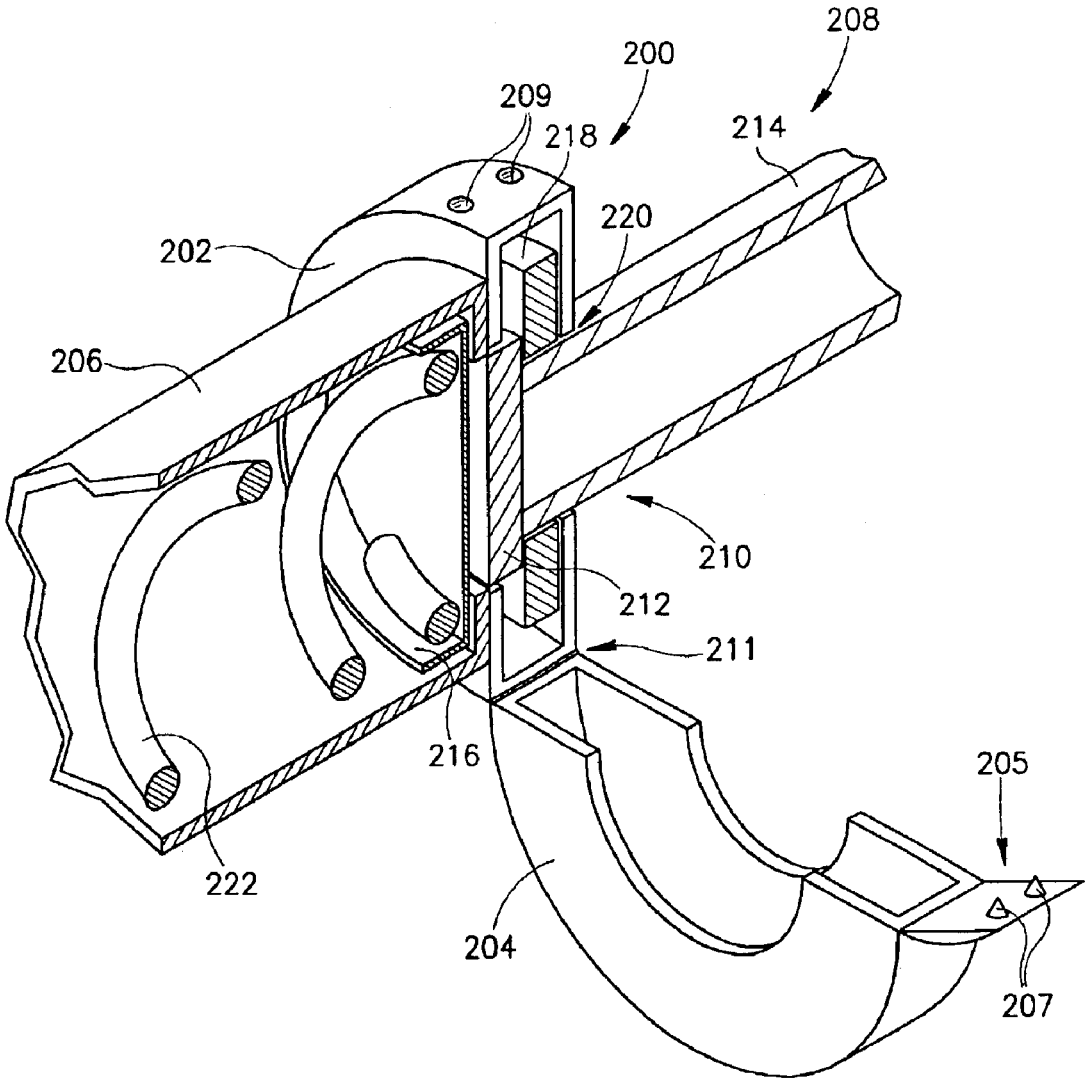
FIGS. 10 and 11 illustrate a cross-sectional partial view of a guide tube having a collar attachment means to accommodate plungers.
Figure 11:
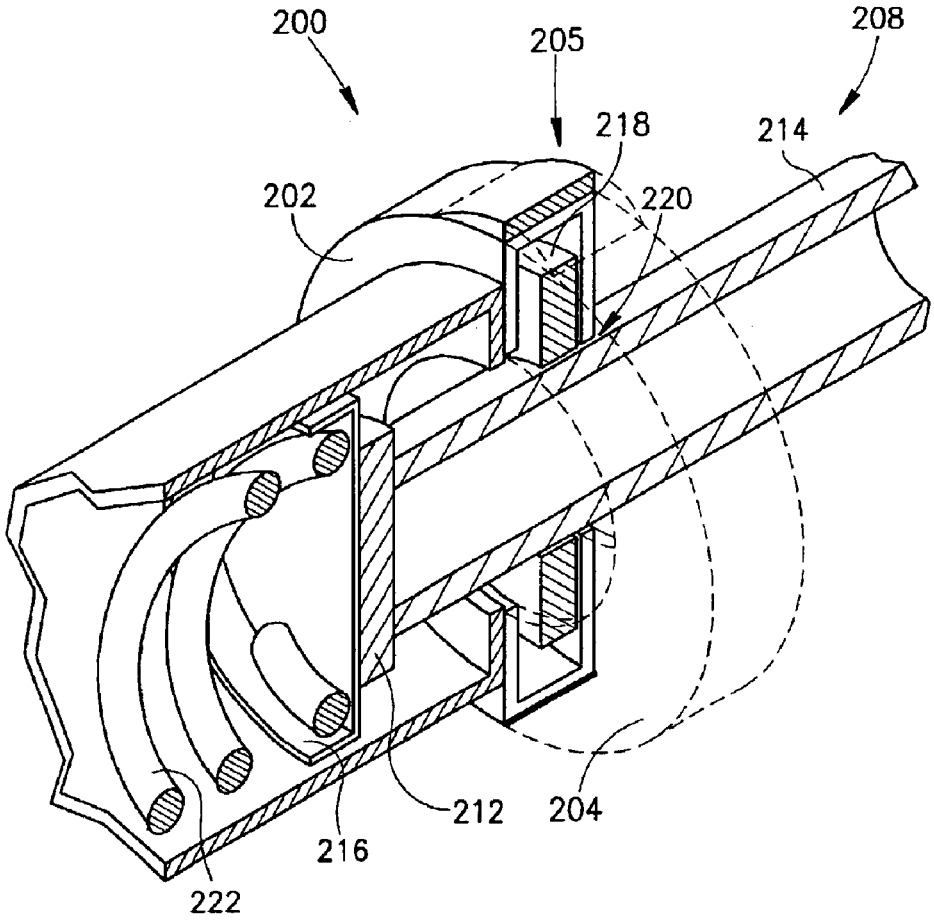
Figure 12:
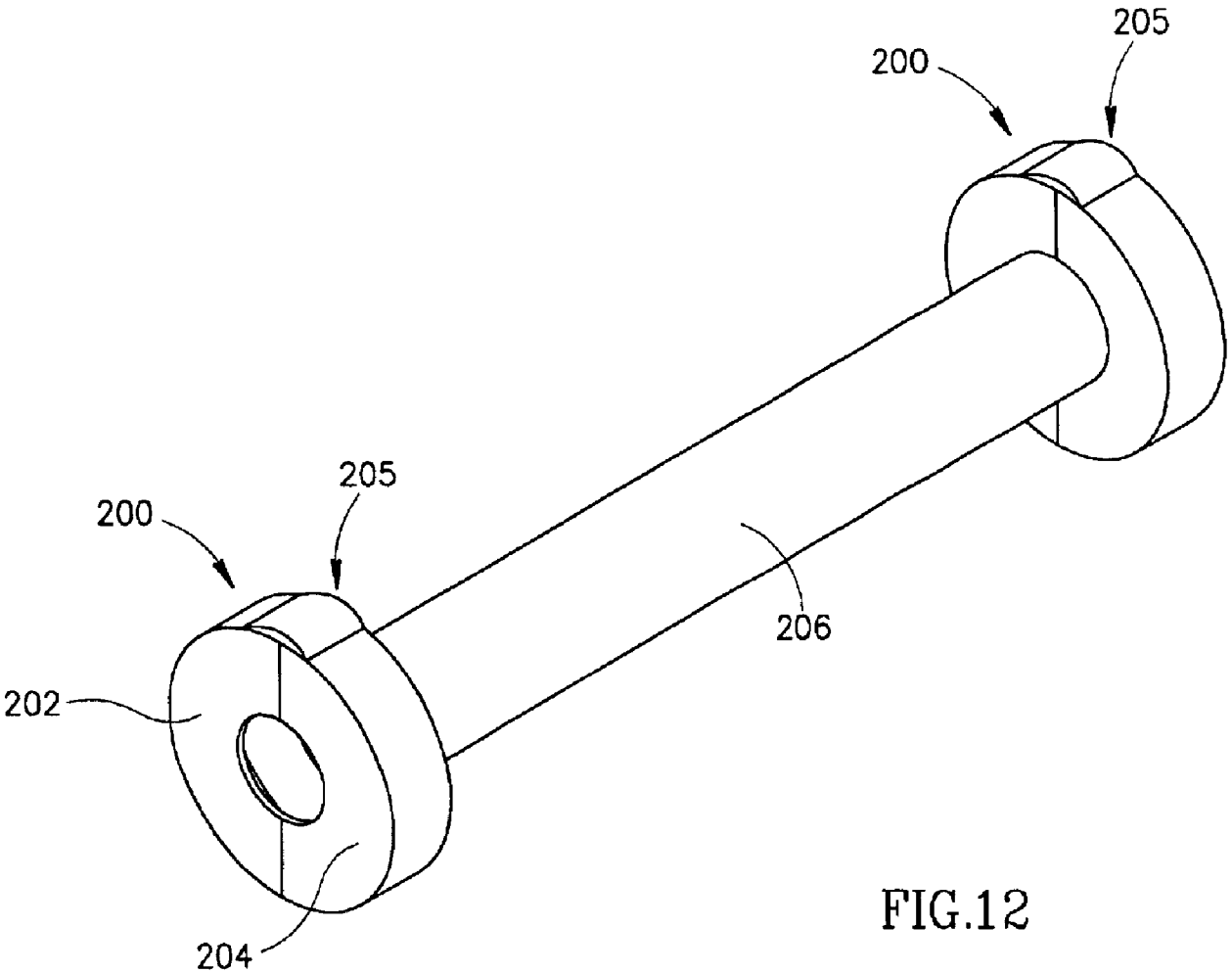
FIG. 12 illustrates a central guide member having collar attachment means at each end.

Referring now to FIGS. 10–12, as an alternative to guide tubes 108 formed on central guide member 102 (as disclosed hereinabove with reference to FIG. 3), there are seen collars 200, each formed of two collar portions 202 and 204. A fixed collar portion 202 is fixably attached to a casing 206 and a closure collar portion 204 is hingably attached to fixed portion 202 by a hinge 211. Collars 200 function to connect plungers 208 to each end of casing 206. Plungers 208 are generally formed in accordance with plungers 112 (as disclosed with reference to FIGS. 4–6) except that at a second end 210 thereof, there is formed a plunger head 212 transverse to plunger shaft 214. After each plunger head 212 together with stopper guide 218 is inserted transversely into fixed collar portion 202, closure collar portion 204 is closed to retain plunger head 212 in position in casing 206 adjacent to cup washer 216 by engaging lugs 207 of collar closure 205 to recesses 209 in fixed portion 202. Stopper guide 218 prevents each plunger head 212 from withdrawing from collar 200. Stopper guide 218 has a central orifice 220 formed therein, having a diameter to permit axial movement of plunger shaft 214 therethrough, and not plunger head 212. There is seen in FIG. 11, mutual contraction of one of plungers 208 in response to opposing axial forces applied thereto via handles (not shown) at first ends thereof, causing plunger heads 212 to push against cup washers 216 thereby to cause depression of springs 222. In FIG. 12, there is seen an external view of casing 206 covered with a softly resilient covering 224, with collars 200 having closed collar portions 202 fixably attached to casing 206 and closure collar portion 204 in a closed position. To disassemble plungers 208 from casing 206, closure collar portion 204 is opened and plunger head 212 is moved transversely out of fixed collar portion 202.

Figure 13:
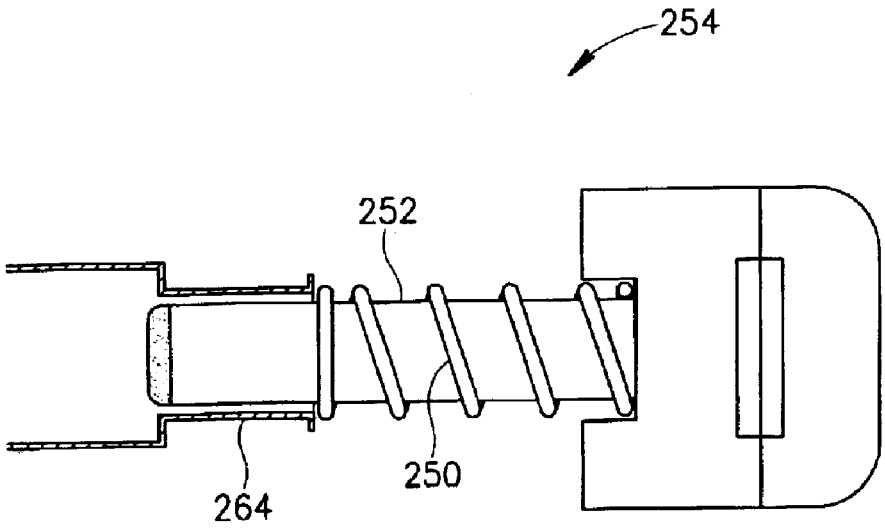
FIGS. 13 and 14 illustrate alternative resilient means according to additional embodiments of the present invention.
Figure 14:
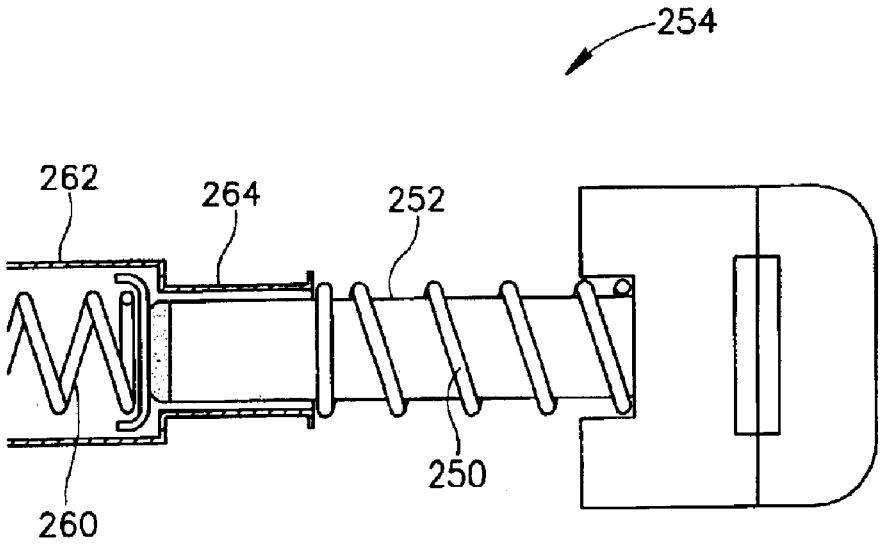

Resilient means 114 (as disclosed in relation to FIG. 3) are disposed within casing 104 in accordance with the preferred embodiment of the present invention. Referring now to FIGS. 13 and 14, in accordance with additional embodiments of the present invention, there are seen alternative arrangements of such resilient means. In FIG. 13, there are seen springs 250, disposed external to each plunger shaft 252, such that depression of plungers generally 254 causes compression of springs 250. In FIG. 14, there is seen a spring 260 disposed within casing 262 (as disclosed as reference 104 in FIG. 3) as well as springs 250 disposed external to plunger shafts 252. Springs 250 are added simply by withdrawing plungers 254 from casing 262 and guide tubes 264 and thereafter sliding springs 250 over each plunger shaft 252, followed by repositioning plungers 254 into guide tubes 264 and into casing 262. The effect of adding springs 250 to plunger shafts 252 is to require a greater compressive force to be applied to each plunger 254, where specific exercises necessitate this. The range of uses of exercise device 100 (FIG. 1) is thereby extended.

Figure 15:
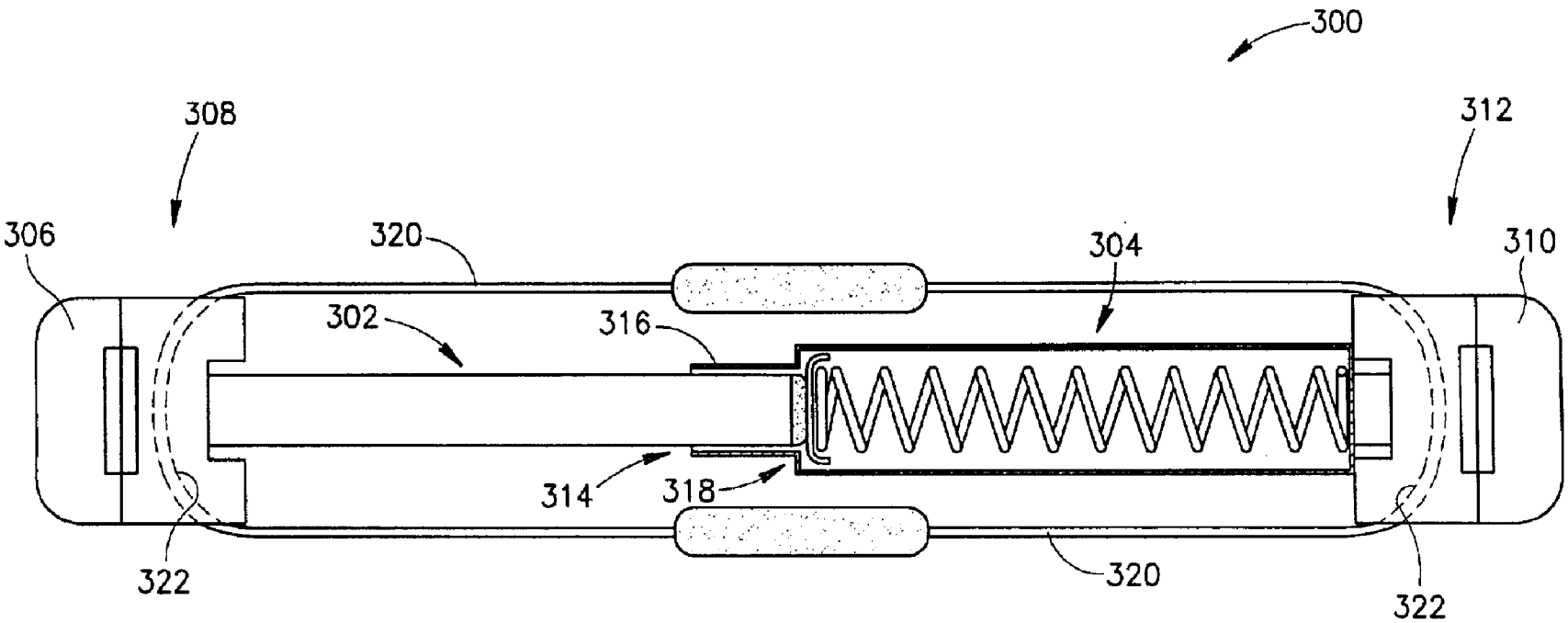
FIG. 15 illustrates a demountable exercise device according to another preferred embodiment of the present invention.
Figure 16:
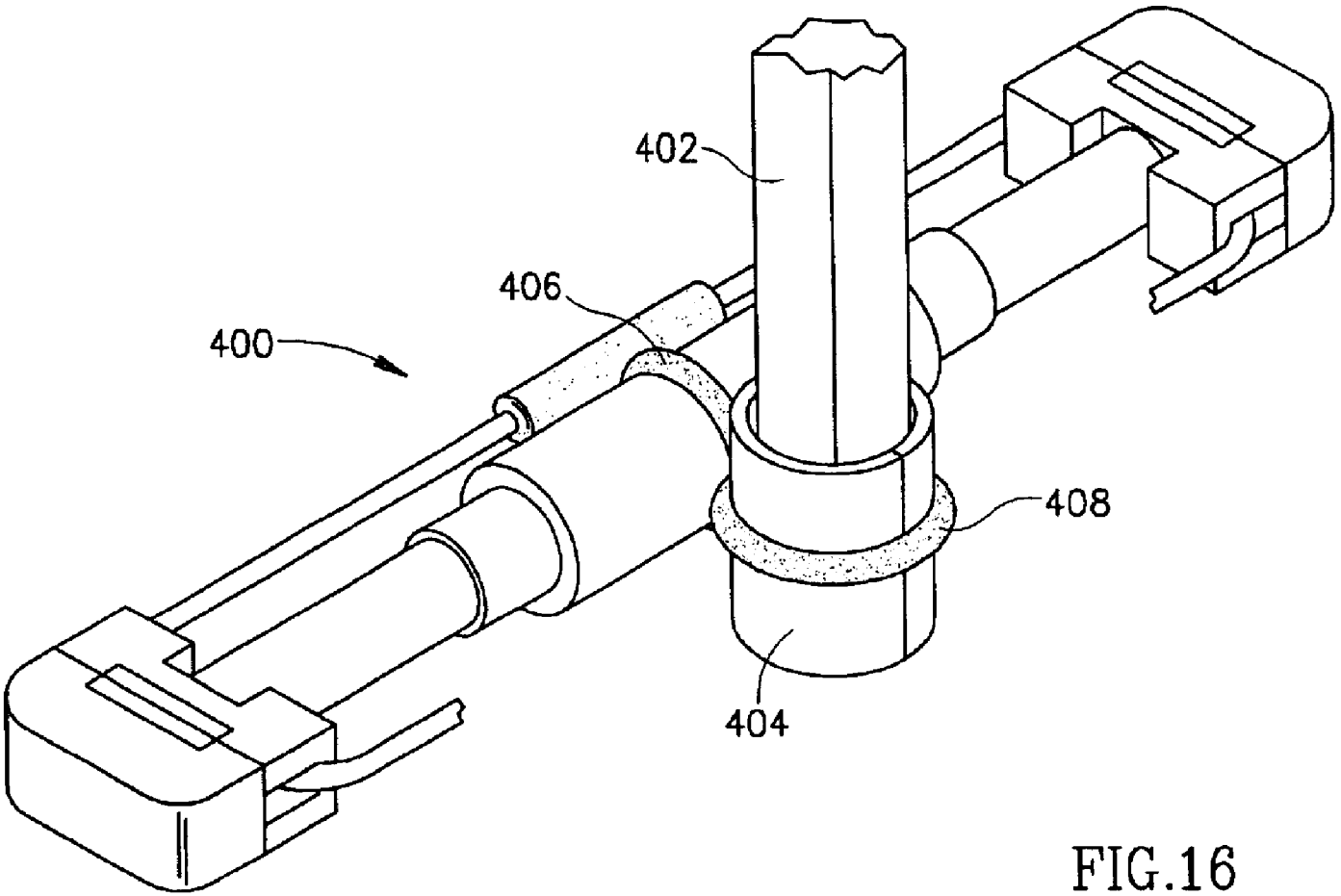
FIG. 16 illustrates a demountable attachment of the demountable exercise device of FIG. 1 to a chair leg.

Referring now to FIG. 15, in accordance with another preferred embodiment of the present invention, there is seen a demountable exercise device 300, comprising a single plunger 302 and a guide member 304. A handle element 306 is fixably attached to a first end 308 of plunger 302, and a similar handle element 310 is fixably attached to a first end 312 of guide member 304. Both handle elements 306 and 310 are formed generally in accordance with handle elements 126 (as disclosed with reference to FIGS. 4–6). Second end 314 of plunger 302 is slidingly inserted into a single guide tube 316 formed at a second end 318 of guide member 304. A flexible member or cord 320 is accommodated into grooves 322 of plunger handle element 306 and of guide member 304 handle element 310 (as disclosed with reference to FIGS. 7–9).

In accordance with various embodiments of the present invention, demountable exercise device 300 may include any or all of the features of the embodiments disclosed hereinabove in relation to FIGS. 8–14 as well as the embodiments disclosed hereinbelow in relation to FIGS. 20–23.

Figure 17:
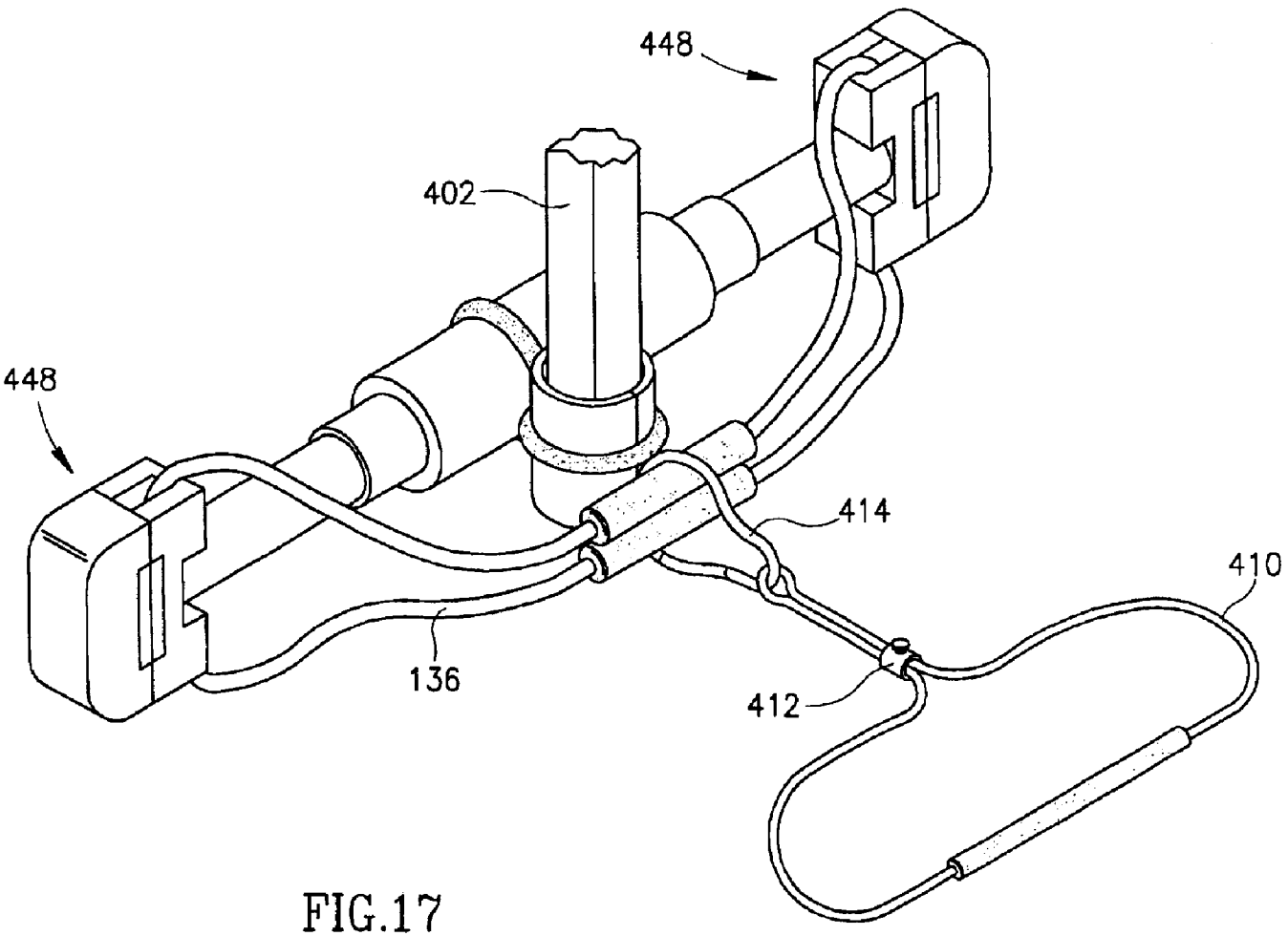
FIG. 17 illustrates an ankle attachment strap for use with the exercise device demountably attached to a chair leg.
Figure 18:
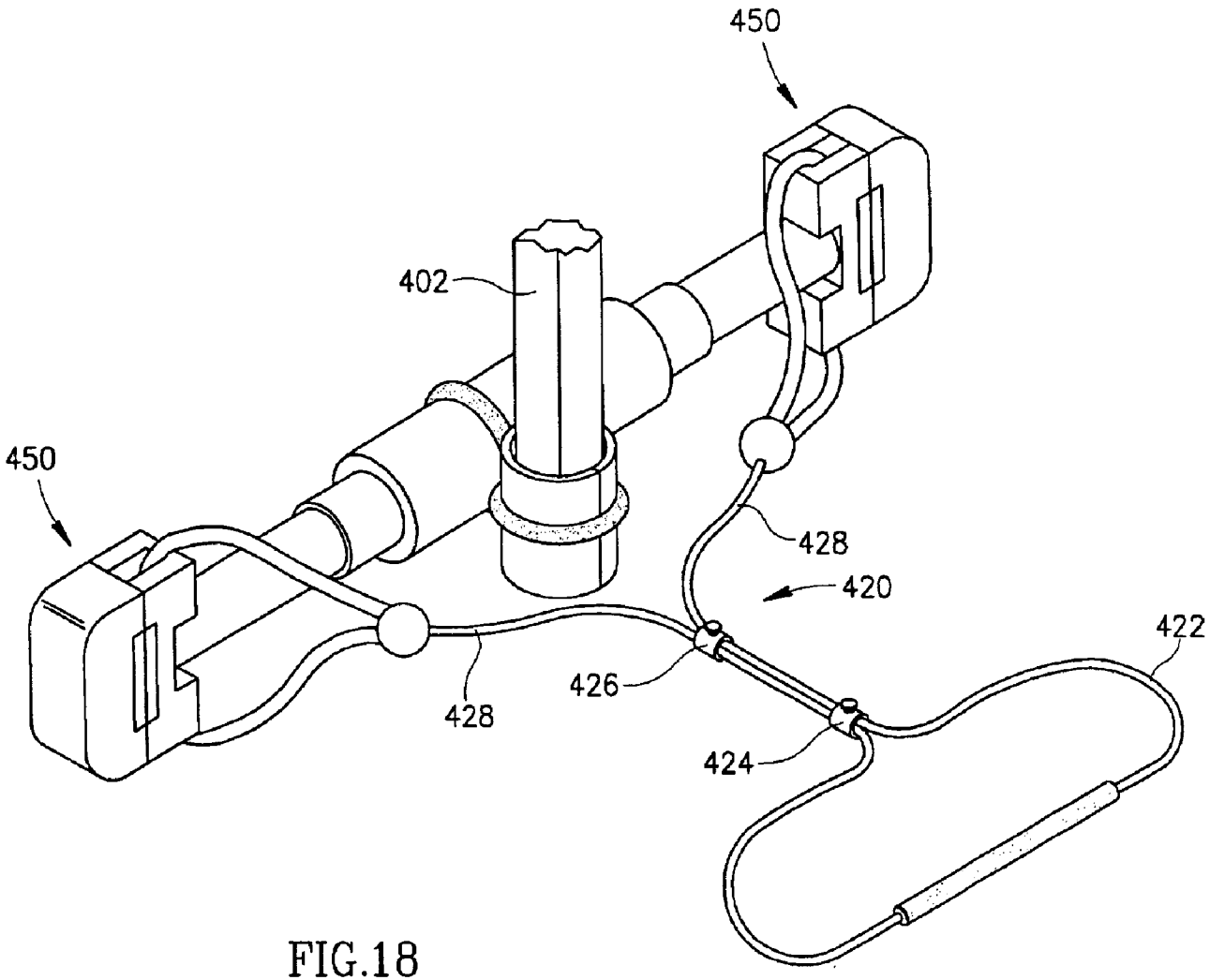
FIG. 18 illustrates an alternative flexible member for use with the exercise device demountably attached to a chair leg.
Figure 19:
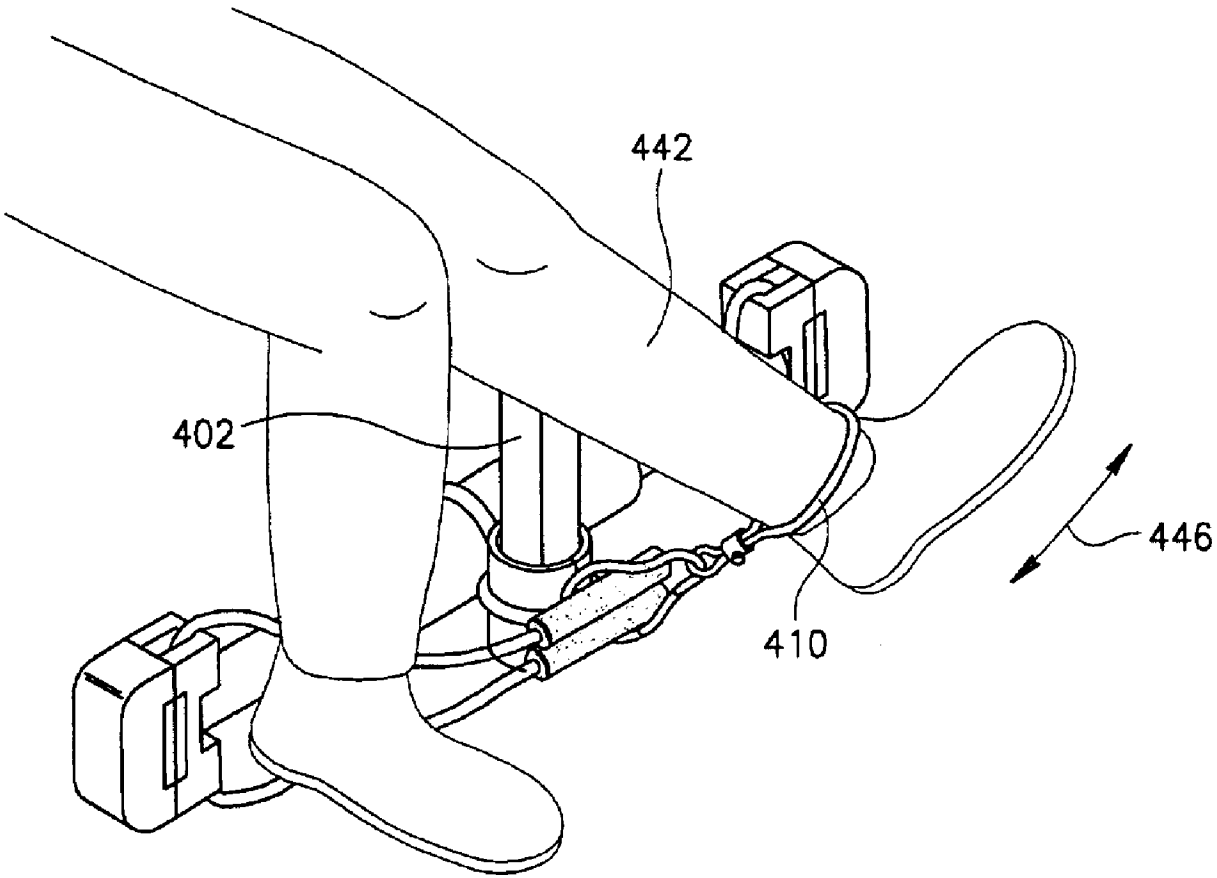
FIG. 19 illustrates a leg exercise using the demountable exercise device as seen in FIGS. 16–18.

Referring now to FIGS. 16–19, there is seen, according to an additional embodiment of the present invention, an application for demountable exercise device 400, whereby device 400 is demountably attached transversely to a chair or stool leg 402. Attachment is achieved by wrapping stool leg 402 with one or more rubber pads 404 and affixing a pair of rotatably connected clamping bands 406 and 408, respectively to exercise device 400 and to stool leg 402. In order to carry out leg exercises, as seen in FIG. 17, by way of example, cord 136 (as disclosed with reference to FIG. 1) may have an ankle attachment strap 410 and ankle fastener 412, attached to cord 136 by a fastener 414. As indicated in FIG. 18, an alternative cord and strap arrangement 420 may be utilized for attachment to the user's ankle. Ankle strap 422 has ankle adjustment fastener 424 for fastening to the user's ankle, and length adjustment fastener 426 to set a preselected tension to cord 428.

In order to carry out various leg exercises, the user sits, for example, on a stool (not shown) with exercise device 400 fastened to stool leg 402. Ankle strap 410 is fastened to ankle 442 of the user. To carry out this exercise, the user raises the leg from a position 444 to a position 446 and returns to position 444. This movement is repeated as required by the user. As the leg moves as indicated by arrow 446, plungers 448 (FIG. 17) or plungers 450 (FIG. 18) are depressed against a resilient spring or springs (not shown) to provide resistance to the movement and then allowed to decompress.

Figure 20:
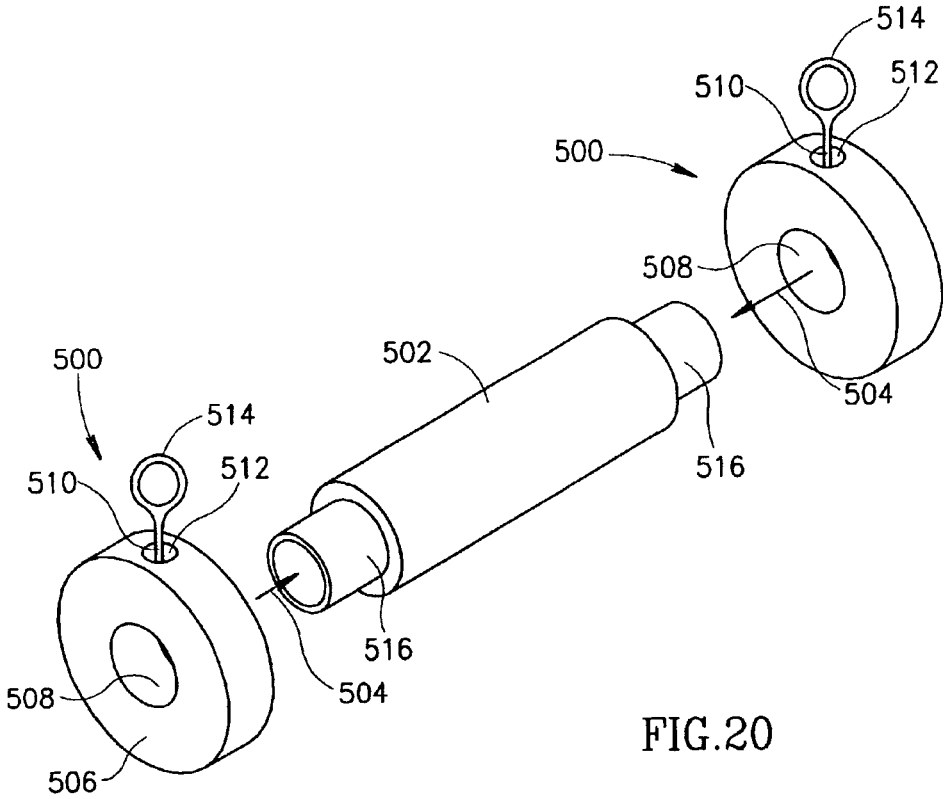
FIG. 20 illustrates a pre-assembly view of a demountable retractable exercise apparatus for use with a demountable multi-purpose exercise device.
Figure 21:
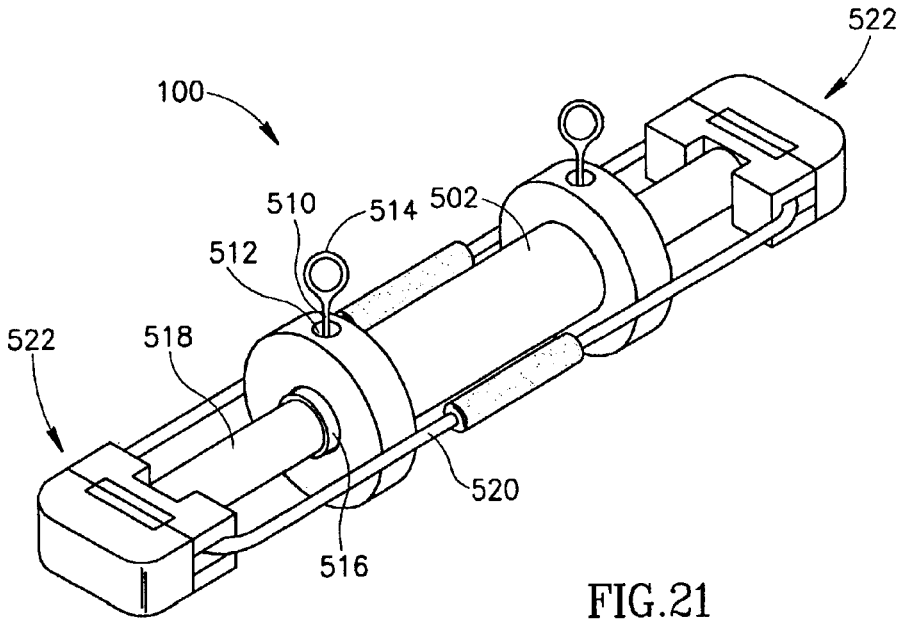
FIG. 21 illustrates an assembly view of the demountable retractable exercise apparatus with a demountable multi-purpose exercise device.

Referring now to FIGS. 20 and 21, in accordance with further preferred embodiments of the present invention, there is seen a pair of demountable exercise apparatus 500 aligned relative to guide tubes 516 of a guide member 502 of a demountable exercise device (referenced 100 as related in relation to FIGS. 1–3) as indicated by arrows 504. Each exercise apparatus 500 comprises an outer cylindrical casing or housing 506, within which there is rotatably-mounted a retractable spool (not shown). A cylindrical axial mounting opening 508 is formed through housing 506 and a retractable spool (not shown). An elongate flexible member or cord 510 is fixably attached at a first end thereof to the retractable spool and is resiliently coiled thereabout. Elongate flexible member or cord 510 projects beyond housing 506, through an orifice 512 and has a handhold 514 formed at a second end thereof.

In FIG. 21, there are seen exercise apparatus 500 demountably attached to a demountable multi-purpose exercise device 100 with cylindrical axial mounting openings 508 fitted over guide tubes 516 to guide member 502 and locked in position to guide tubes 516 by fasteners (not shown). Thereafter two elongate plunger members 518 are inserted into guide tubes 516 and flexible member or cord 520 is attached to handle elements 522 (generally as disclosed in relation to FIGS. 1–6).

Figure 22:
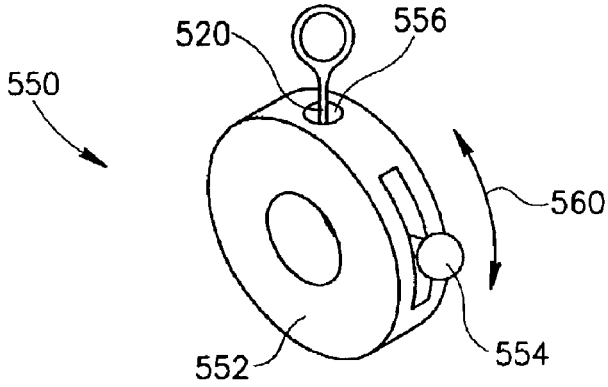
FIG. 22 illustrates a view of the demountable retractable exercise apparatus for use with a demountable multi-purpose exercise device.

Referring now to FIG. 22, there is seen a single exercise apparatus 550, having disposed on casing 552, a brake element 554 thereby to apply variable resistance to rotation of a retractable spool member (not shown) therein. This applied variable resistance provides for variable force needed to withdraw cord 520 from casing 552 through opening 556, by pulling on handhold 514 (as seen in FIGS. 20 and 21). Moving brake element 554 in the directions indicated by arrow 560 provides a greater or lesser resistance to withdrawing cord 520.

Figure 23:
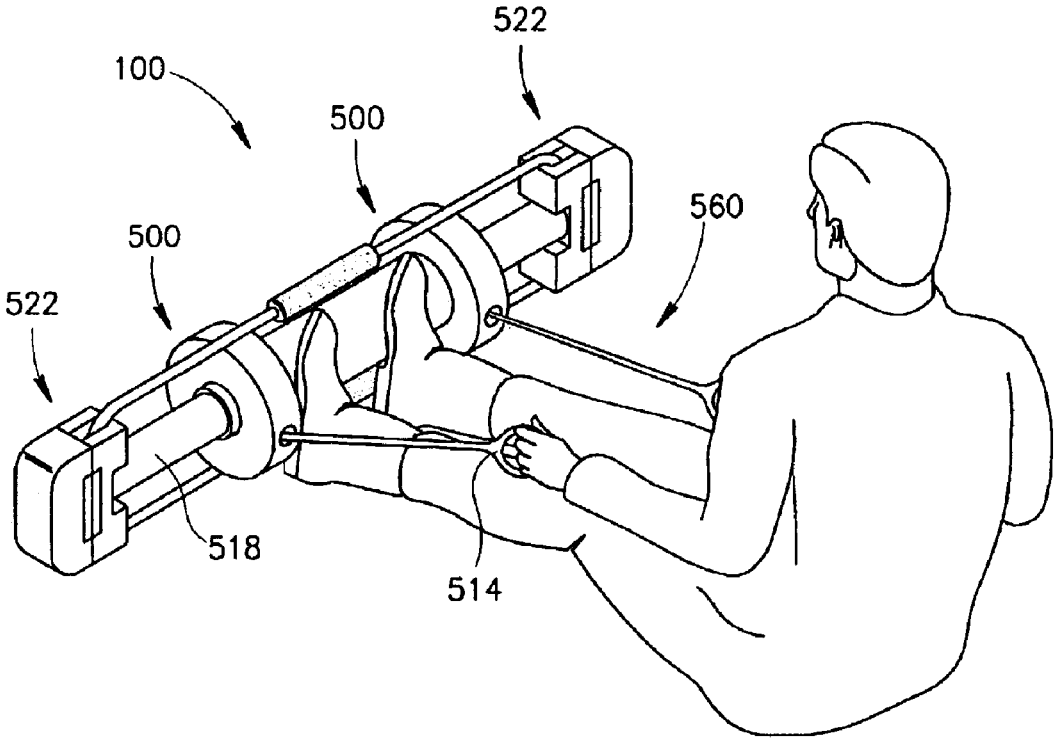
FIG. 23 illustrates the demountable retractable exercise apparatus as shown in FIG. 21 used for a rowing exercise.

Referring now to FIG. 23, there is illustrated, as an example, a rowing exercise 560 carried out using a pair of exercise members 500 mounted on a demountable multi-purpose exercise device 100 (as disclosed in relation to FIGS. 20–22).

Alternative exercises are carried out using a pair of exercise apparatus 500 in conjunction with a simultaneous depression of elongate plunger members 518. For example, a variation of the rowing exercise 560 (disclosed in relation to FIG. 23) may be performed with handholds 514 fastened over the feet or to a fixed or stationary object. Demountable multi-purpose exercise device 100 is drawn towards the user while the user simultaneously depresses handle elements 522 of elongate plunger members 518.

Figure 24:
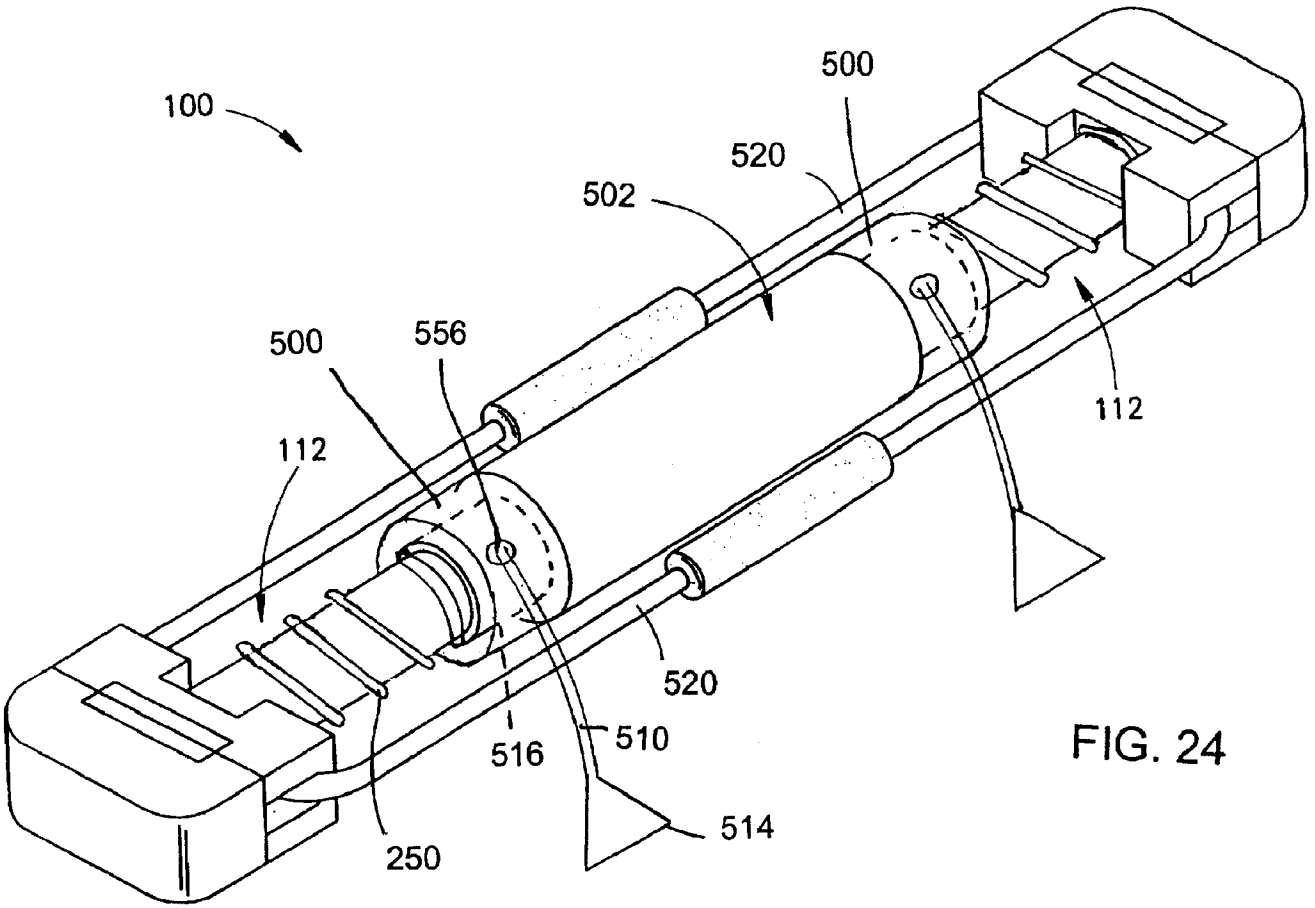
FIG. 24 is a perspective view of the demountable exercise device in accordance with another embodiment of the present invention for aerobic exercise.
Figure 25:
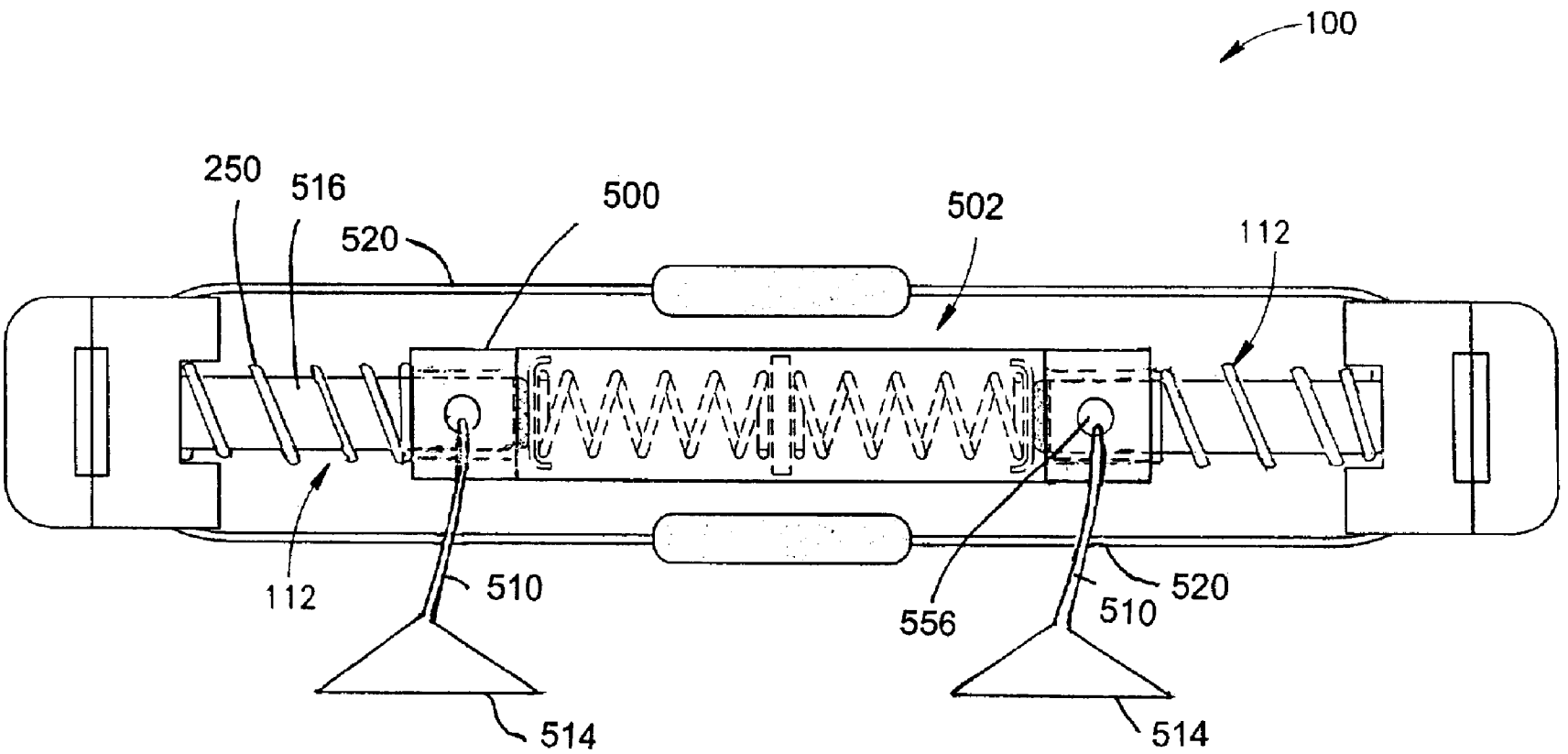
FIG. 25 is a cross-sectional view of the demountable exercise device of FIG. 24.
Figure 26:
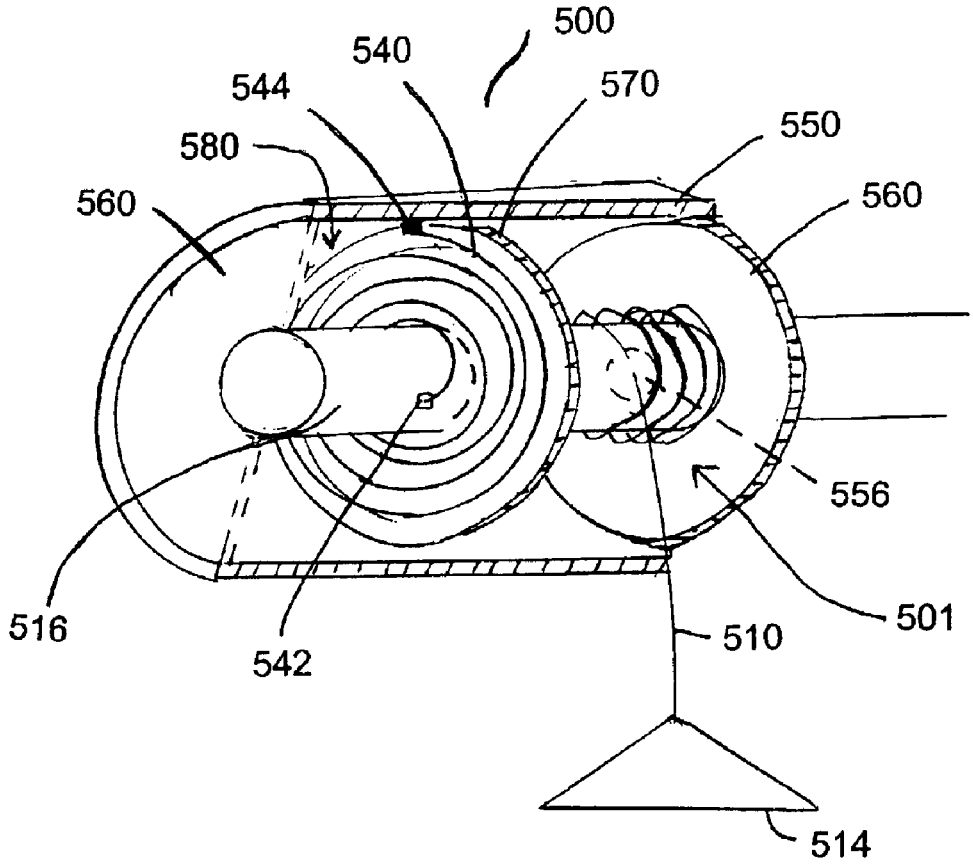
FIG. 26 is a perspective view of the cable drum assembly of the demountable exercise device of FIGS. 24 and 25.

A further embodiment of the present invention is shown in FIGS. 24–26. In this embodiment, the exercise device 100 may be readily adapted to provide a multitude of aerobic rowing and strengthening exercises, such as arm curls. As shown in FIG. 26, a cable drum assembly 500 is structurally arranged to be mounted onto the ends of central guide member 502, as shown in FIGS. 24 and 25. The drum assembly 500 includes a rotating drum portion 501 which permits a cable 510 to be wrapped therearound when the drum portion is in an inward, at-rest position. As the cable 510 is pulled from the cable drum 500 through the opening 556 from the collapsed position to an outward, extended position, a tensioning spring 540 or other resilient type member provides an increased resistance to the pulling of the cable 510 from the cable drum. When the tension on cable 510 is released from the pulled, extended position, the tensioning spring 540 relaxes to its original at-rest position and the rotating drum portion 501 is rotated to store the cable in the inward, at-rest position.

In FIG. 26, the cable drum assembly 500 is comprised of a cylindrical housing 550 having two end housing walls 560 at each end thereof, with the housing structurally arranged to be mounted on shaft 518. The cable drum assembly, preferably, includes a dividing panel wall 570 positioned within the cylindrical housing 550, which separates a tensioning spring or resilient member 540 from the rotating drum portion 501 to provide a tensioning portion 580. The rotating drum portion is adapted to store the cable 510 when the cable is in the collapsed position. One end 542 of the spring member 540 is anchored to the shaft 516 and the other end 544 is anchored to the inner wall surface of the cable housing 550. Specifically, as the handle 514 on cable 510 is pulled outwardly, the shaft 516 rotates and the coil spring is wound tightly around the outside surface of shaft 516. When the handle 514 is released, the pressure upon the coil spring member is released, expelling its wound energy. As the coil spring relaxes, it rotates the rotating drum portion of the element 500 in a counterclockwise direction which rewinds the cable 510 within the drum assembly 500. The coil spring may be a metal spring, elastic or rubber material.

It is within the scope of the present invention that the resilient member may be comprised of a first resilient member structurally arranged within the cylindrical housing 550 to provide an opposing force to the rotating drum portion 501. This opposing force permits the cable to be rewound onto the rotating drum position. A second resilient member is structurally arranged to adjustably engage shaft 518 to provide an adjustable opposing force to the pulling of the cable 510 from the drum assembly.

Figure 27:
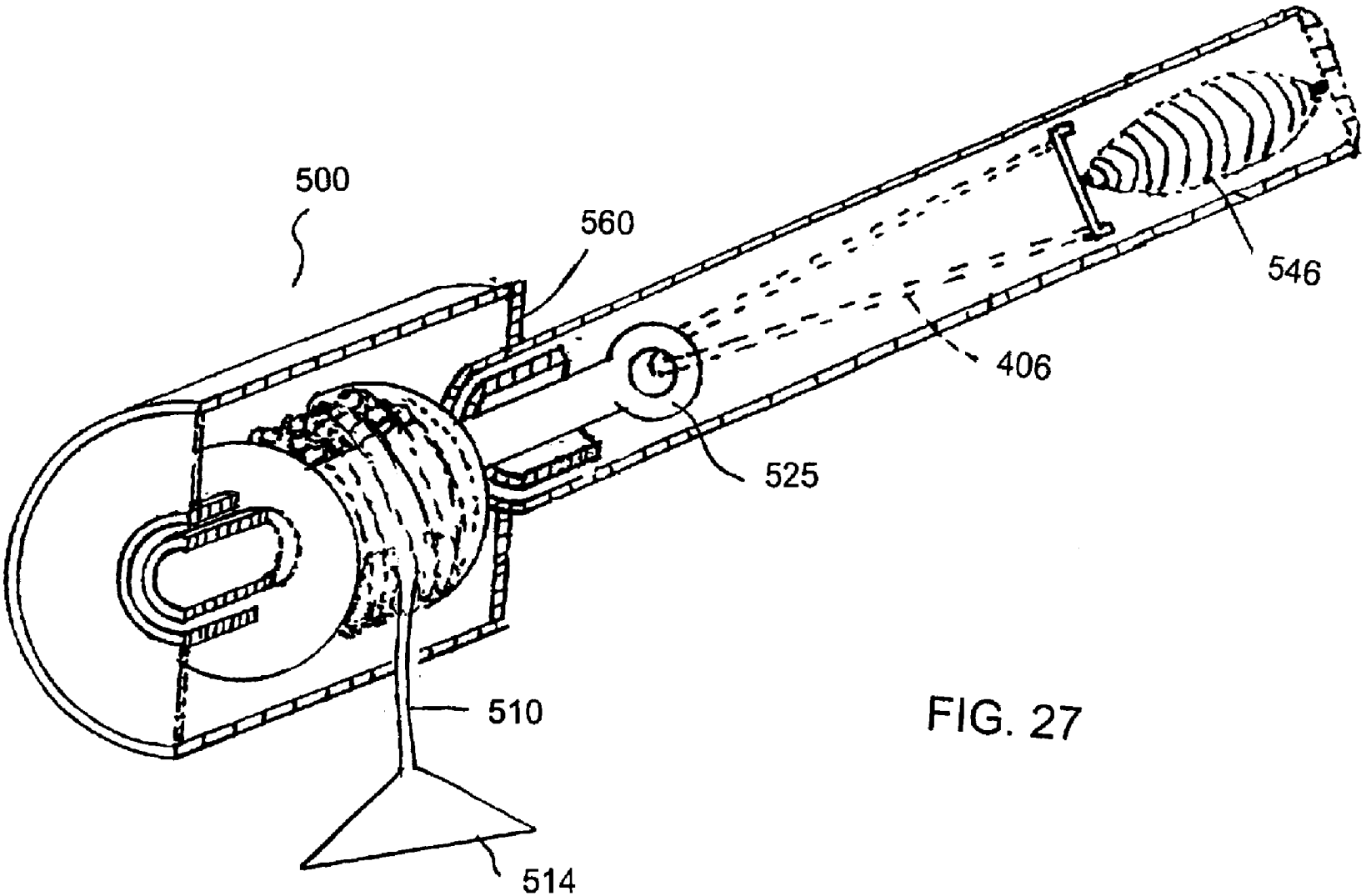
FIG. 27 is a cross-sectional view of a portion of the demountable exercise device in accordance with another embodiment of the present invention.

FIG. 27 describes a further embodiment of the present invention wherein the inside end housing wall 560 of the drum assembly 500 is attached through eyelet 500 to an elastic member or members 406 which are secured to a compression spring 546. In operation, as the handle 514 and associated cable 510 is pulled outwardly, the elastic member or members 406 are twisted and tightened which results in the axial expansion of spring 546, which increases the pressure or force against the pulling of the cable to its outward extended position. Again, upon release of the cable member 514, the spring 546 and elastic member 406 will drive the rotating drum in a counterclockwise direction, which rewinds the cable 514 onto the rotating drum portion.

Figure 28:
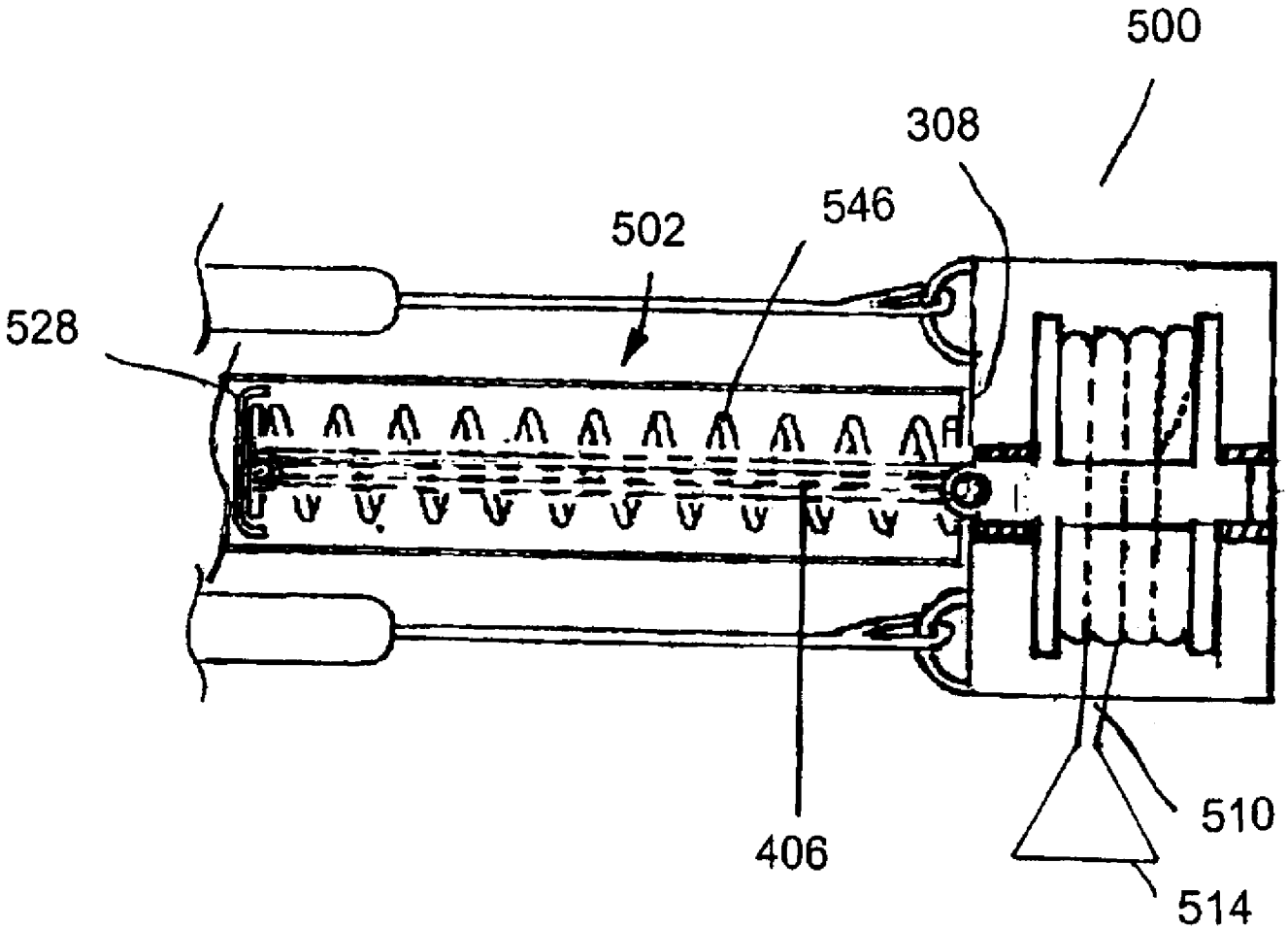
FIG. 28 is a cross-sectional view of a portion of the demountable exercise device in accordance with still another embodiment of the present invention.

A still further embodiment of the present invention is the utilization of a drum assembly 500 structurally arranged to be mounted to the ends of a central guide member 502 which includes a compression spring 546 mounted therein which, in turn, is positioned about an elastic member or members 406 which are secured to the drum assembly 500, as shown in FIG. 28 and to an inner shoulder member 528, which separates the guide member into halves. This embodiment of the present invention is a modification of the device, as shown in FIG. 15. Briefly, the handle 312 is removed and replaced by a modified cable drum assembly 500. The cable drum 500 is structurally arranged to be rotatably mounted to the extension end 308 of the compression spring 546. As the cable 510 is pulled outwardly from the cable drum 500, the tension on the elastic member or members is increased, thereby compressing spring 546. Compressed spring 546 is mounted along the axis of the unit and provides a force against the movement of the cable from the inward, at-rest position to the outward, extended position.

It will be appreciated by persons skilled in the art that the present invention is not limited to the exercise examples disclosed hereinabove, but may be utilized in a multitude of exercises using combinations of the various components, apparatus, members and elements of the present invention.

It will be appreciated by persons skilled in the art that the present invention is not limited by the drawings and description hereinabove presented. Rather, the invention is defined solely by the claims that follow.

The invention claimed is:

1. A demountable multi-purpose exercise device, including:

a) a pair of elongate plunger members, each having a first end portion and a second end portion; and including at least one handhold disposed along a portion of said elongate flexible member and affixed thereto to provide a means for gripping said elongate flexible member;

b) a central guide member having a pair of oppositely disposed portions for demountable telescopic engagement with said second end portions of said pair of elongate plunger members;

c) depressible resilient means disposed between said pair of elongate plunger members and said central guide member, operative to permit mutual contraction of said plunger members in response to opposing axial forces of at least a predetermined magnitude applied thereto via said first ends thereof; and d) an elongate flexible member operative to be longitudinally looped about the remainder of said exercise device in engagement with said first end portions of said pair of elongate plunger members, and configured to be of a length so as to retain said pair of plunger members in engagement with said central guide member.

2. A demountable multi-purpose exercise device, including:

a) a pair of elongate plunger members, each having a first end portion and a second end portion;

b) a central guide member having a pair of oppositely disposed portions for demountable telescopic engagement with said second end portions of said pair of elongate plunger members;

c) depressible resilient means disposed between said pair of elongate plunger members and said central guide member, operative to permit mutual contraction of said plunger members in response to opposing axial forces of at least a predetermined magnitude applied thereto via said first ends thereof; and d) an elongate flexible member operative to be longitudinally looped about the remainder of said exercise device in engagement with said first end portions of said pair of elongate plunger members, and configured to be of a length so as to retain said pair of plunger members in engagement with said central guide member and wherein said elongate flexible member includes attached thereto an extended elongate flexible element to attach said elongate flexible member to a user's limbs.

3. A demountable multi-purpose exercise device including:

a) an elongate plunger member, having a first end portion and a second end portion;

b) a guide member having a first end portion and a second end portion oppositely disposed such that said second end portion is formed for demountable telescopic engagement with said second end portion of said elongate plunger member;

c) depressible resilient means provided between said elongate plunger member and said guide member, operative to permit mutual contraction of said elongate plunger member and said guide member in response to opposing axial forces applied thereto via said first end portion of said plunger member and said first end portion of said guide member;

d) an elongate flexible member operative to be longitudinally looped about the remainder of said exercise device in engagement with said first end portion of said elongate plunger member and said guide member, and configured to be of a length so as to retain said pair of plunger members in engagement with said central guide member; and e) means for selectably fastening said elongate flexible to said first end portion of said elongate plunger member and said guide member.

4. A demountable multi-purpose exercise device, including:

a) an elongate plunger member, having a first end portion and a second end portion;

b) a guide member having a first end portion and a second end portion oppositely disposed such that said second end portion is formed for demountable telescopic engagement with said second end portion of said elongate plunger member;

c) depressible resilient means provided between said elongate plunger member and said guide member, operative to permit mutual contraction of said elongate plunger member and said guide member in response to opposing axial forces applied thereto via said first end portion of said plunger member and said first end portion of said guide member; and d) an elongate flexible member which includes at least one handhold disposed along a portion of said flexible member and affixed thereto to provide a means for gripping said flexible member.

5. A demountable multi-purpose exercise device, including:

a) an elongate plunger member, having a first end portion and a second end portion;

b) a guide member having a first end portion and a second end portion oppositely disposed such that said second end portion is formed for demountable telescopic engagement with said second end portion of said elongate plunger member;

c) depressible resilient means provided between said elongate plunger member and said guide member, operative to permit mutual contraction of said elongate plunger member and said guide member in response to opposing axial forces applied thereto via said first end portion of said plunger member and said first end portion of said guide member; and d) an elongate flexible member operative to be longitudinally looped about the remainder of said exercise device in engagement with said first end portion of said elongate plunger member and said guide member, and configured to be of a length so as to retain said pair of plunger members in engagement with said central guide member and wherein said elongate flexible member includes attached thereto an extended elongate flexible element to attach said extended elongate flexible element to a user's limbs.

6. For use with a demountable multi-purpose exercise device which includes a pair of elongate plunger members and a guide member arranged for mutual, relative, resilient contraction along a common axis, exercise apparatus which includes:

a) at least one retractable spool member rotationally mounted within a substantially cylindrical casing having a cylindrical axial mounting opening formed therethrough; and b) at least one elongate flexible member fixably attached by a first end thereof to said at least one spool member and arranged to be resiliently coiled thereabout and adapted to be uncoiled in response to a force greater than a resistance force applied thereto via said spool member, said at least one retractable spool member operative to recoil said at least one elongate flexible member thereabout in the absence of a force greater than the resistance force.

7. Exercise apparatus according to claim 6 wherein at least one of said exercise apparatus is demountably disposed on said guide member.

8. Exercise apparatus according to claim 6 wherein said exercise apparatus includes a brake element disposed thereon so as to apply a preselected resistance force to said retractable spool member.

9. A demountable multi-purpose exercise device including:

a pair of elongate plunger members, each having a first end portion and a second end portion;

a central guide member having a pair of opposite disposed portions for demountable telescopic engagement with said second end portions of said pair of elongate plunger members;

a pair of drum assemblies, each structurally arranged for demountable engagement with said second end portions of said pair of elongate plunger members; a cable member secured to each of said drum assemblies and extendable between an inward at-rest position and an outward extended position;

wherein each of said drum assemblies includes a non-rotating radial housing portion, a rotating drum portion for storing said cable member when said cable is in the inward, at-rest position; and at least one resilient member associated with said drum assembly to provide an opposing force during the pulling of said cable member from said inward at-rest position to said outward extended position and to provide a force to rotate said drum assembly to return said cable to said inward at-rest position.

10. A demountable multi-purpose exercise device in accordance with claim 9, wherein said at least one resilient member includes one end secured to said non-rotating housing portion and one end secured to said rotating drum portion.

11. A demountable multi-purpose exercise device in accordance with claim 10, wherein said resilient member is a tensioning spring.

12. A demountable multi-purpose exercise device in accordance with claim 9, wherein first and second resilient members are associated with said drum assembly, with said second resilient member providing an opposing force during the pulling of said cable member from said at-rest position to said extended position and said first resilient member providing a force to rotate said drum assembly to return said cable to said at rest position.

13. A demountable multi-purpose exercise device in accordance with claim 11, wherein said first resilient member is structurally arranged to provide an adjustable opposing force.

14. A demountable multi-purpose exercise device including:

a central guide member having a pair of opposite disposed end portions;

a pair of drum assemblies, each structurally arranged for demountable engagement with said end portions of said central guide member;

at least one spring member positioned within said central guide member;

a cable member secured to each of said drum assemblies and extendable between an inward at-rest position and an outward extended position;

wherein each of said drum assemblies includes a rotating drum portion for storing said cable member when said cable is in the inward, at-rest position; and at least one resilient member associated with said rotating drum assembly and said central spring member to prove an opposing axial force during the pulling of said cable member from said inward at-rest position to said outward extended position and to provide a force to rotate said drum assembly to return said cable to said inward at-rest position.

15. A demountable multi-purpose exercise device in accordance with claim 12, wherein said resilient member includes one end secured to said rotating drum portion and the other end secured to said spring member.

16. A demountable multi-purpose exercise device in accordance with claim 12, wherein said resilient member includes one end secured to said rotating drum portion and the end secured to said central guide member.

* * * * *